US008944532B2

(12) United States Patent
Tontarelli

(10) Patent No.: US 8,944,532 B2
(45) Date of Patent: Feb. 3, 2015

(54) MODULAR APPARATUS FOR REALIZATION OF WARDROBES PROVIDED WITH PLASTIC STRUCTURE

(76) Inventor: Sergio Tontarelli, Castelfidardo (IT)

( * ) Notice: Subject to any disclaimer, the term of this patent is extended or adjusted under 35 U.S.C. 154(b) by 0 days.

(21) Appl. No.: 14/235,968

(22) PCT Filed: Apr. 23, 2012

(86) PCT No.: PCT/EP2012/057354

§ 371 (c)(1),
(2), (4) Date: Jan. 29, 2014

(87) PCT Pub. No.: WO2013/020721

PCT Pub. Date: Feb. 14, 2013

(65) Prior Publication Data

US 2014/0152160 A1 Jun. 5, 2014

(30) Foreign Application Priority Data

Aug. 10, 2011 (IT) ..... AN2011U0056

(51) Int. Cl.
*A47B 47/00* (2006.01)
*A47B 47/04* (2006.01)
*A47B 61/00* (2006.01)

(52) U.S. Cl.
CPC ..... *A47B 47/04* (2013.01); *A47B 47/042* (2013.01); *A47B 61/00* (2013.01)
USPC ..... 312/263; 312/265.5; 312/108

(58) Field of Classification Search
CPC .... A47B 87/02; A47B 87/0215; A47B 47/03; A47B 47/042; A47B 47/047
USPC ..... 312/108, 111, 263, 265.5
See application file for complete search history.

(56) References Cited

U.S. PATENT DOCUMENTS

| | | | | |
|---|---|---|---|---|
| 3,874,753 | A * | 4/1975 | Naito et al. | 312/111 |
| 4,021,089 | A * | 5/1977 | Bush | 312/265.5 |
| 4,171,150 | A * | 10/1979 | Soderlund | 312/107 |
| 5,372,415 | A * | 12/1994 | Tisbo et al. | 312/108 |
| 5,466,058 | A * | 11/1995 | Chan | 312/111 |
| 5,931,553 | A * | 8/1999 | Cohen | 312/263 |
| 5,975,660 | A * | 11/1999 | Tisbo et al. | 312/263 |
| 6,099,092 | A * | 8/2000 | Uffner et al. | 312/108 |
| 6,193,340 | B1 * | 2/2001 | Schenker et al. | 312/265.5 |
| 6,250,022 | B1 * | 6/2001 | Paz et al. | 52/79.5 |
| 6,474,759 | B2 * | 11/2002 | Hsu | 312/263 |
| 6,820,950 | B1 * | 11/2004 | Sun | 312/108 |
| 7,395,634 | B2 * | 7/2008 | Anderson et al. | 52/79.1 |
| 8,388,073 | B2 * | 3/2013 | Richter | 312/108 |
| 8,650,807 | B2 * | 2/2014 | McKimmy et al. | 52/79.9 |
| 2002/0109442 | A1 | 8/2002 | Hsu | |
| 2002/0125799 | A1 * | 9/2002 | Landsberger et al. | 312/209 |
| 2005/0168115 | A1 | 8/2005 | Moon et al. | |
| 2009/0251031 | A1 * | 10/2009 | Chen | 312/108 |

OTHER PUBLICATIONS

International Search Report for corresponding International Application No. PCT/EP2012/057354.

* cited by examiner

*Primary Examiner* — Hanh V Tran
(74) *Attorney, Agent, or Firm* — Egbert Law Offices, PLLC

(57) ABSTRACT

A modular apparatus is composed of a plurality of modules obtained from molding plastic materials and adapted to be combined at the user's discretion in order to obtain pieces of furniture with different shapes and dimensions, preferably wardrobes.

37 Claims, 39 Drawing Sheets

MODULAR APPARATUS FOR REALIZATION OF WARDROBES PROVIDED WITH PLASTIC STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN SUBMITTED ON COMPACT DISC

Not applicable.

BACKGROUND OF THE INVENTION

1. Field of the Invention

The present patent application relates to a modular apparatus used to realize furniture, basically wardrobes, provided with plastic structure.

The present invention has been devised, further to a careful examination of the current requirements of the furniture market.

2. Description of Related An Including Information Disclosed Under 37 CFR 1.97 and 37 CFR 1.98.

More and more often, consumers are searching for furniture characterized by versatility of use, in addition to low prices and pleasant aesthetics.

In particular, furniture must adjust easily to the available space and to the actual needs. At the same time it must be possible to change its configuration rapidly, according to changing needs, without requiring substantial modifications and without using specialized labor.

SUMMARY OF THE INVENTION

The specific purpose of the apparatus of the invention is to satisfy all the aforementioned needs, when making a wardrobe or another piece of furniture of the same type.

The specific usefulness of the apparatus of the invention is not to realize wardrobes with a special external shape. The purpose is to allow users to configure their furniture according to their specific requirements, while reducing costs to affordable levels.

The apparatus of the invention has achieved such a purpose, while comprising a limited number of modules characterized by high versatility.

It must be noted that the modules of the apparatus of the invention can be combined as desired by the user to generate wardrobes with any height, according to the number of internal shelves used.

The same components used to realize a wardrobe with one shelf can be also used in a larger number of specimens to realize wardrobes with one, three or more shelves.

Moreover, the fact that all modular components re obtained from molding plastic materials is justified by the need to reduce their cost and weight.

A further advantageous characteristic of the apparatus according to the invention relates to the capability of the various modules to provide stable coupling, without using external connection means, such as screws, plugs and the like.

Furthermore, the various modules of the apparatus according to the invention are capable of creating, in a corresponding piece of furniture, a self-bearing framework that is not simply limited to act as a simple "covering" structure for the furniture.

Such a provision is appreciated in view of the possibility for anyone to create pieces of furniture easily and rapidly, in total safety in terms of final result.

BRIEF DESCRIPTION OF THE SEVERAL VIEWS OF THE DRAWINGS

For illustrative reasons the description of the invention continues with reference to the attached drawings, which only have an illustrative, not limiting value, wherein.

DETAILED DESCRIPTION OF THE INVENTION

Referring to the aforesaid figures, the apparatus of the invention is composed of a series of modules obtained from molding plastic materials, which earl be used from time to time in the desired number and combination in order to realize wardrobes with or without front doors.

To that end, each of said modules is provided with coupling means associated with stopping means, adapted to cooperate with corresponding coupling and stopping means provided in the other modules.

Figure 1A:
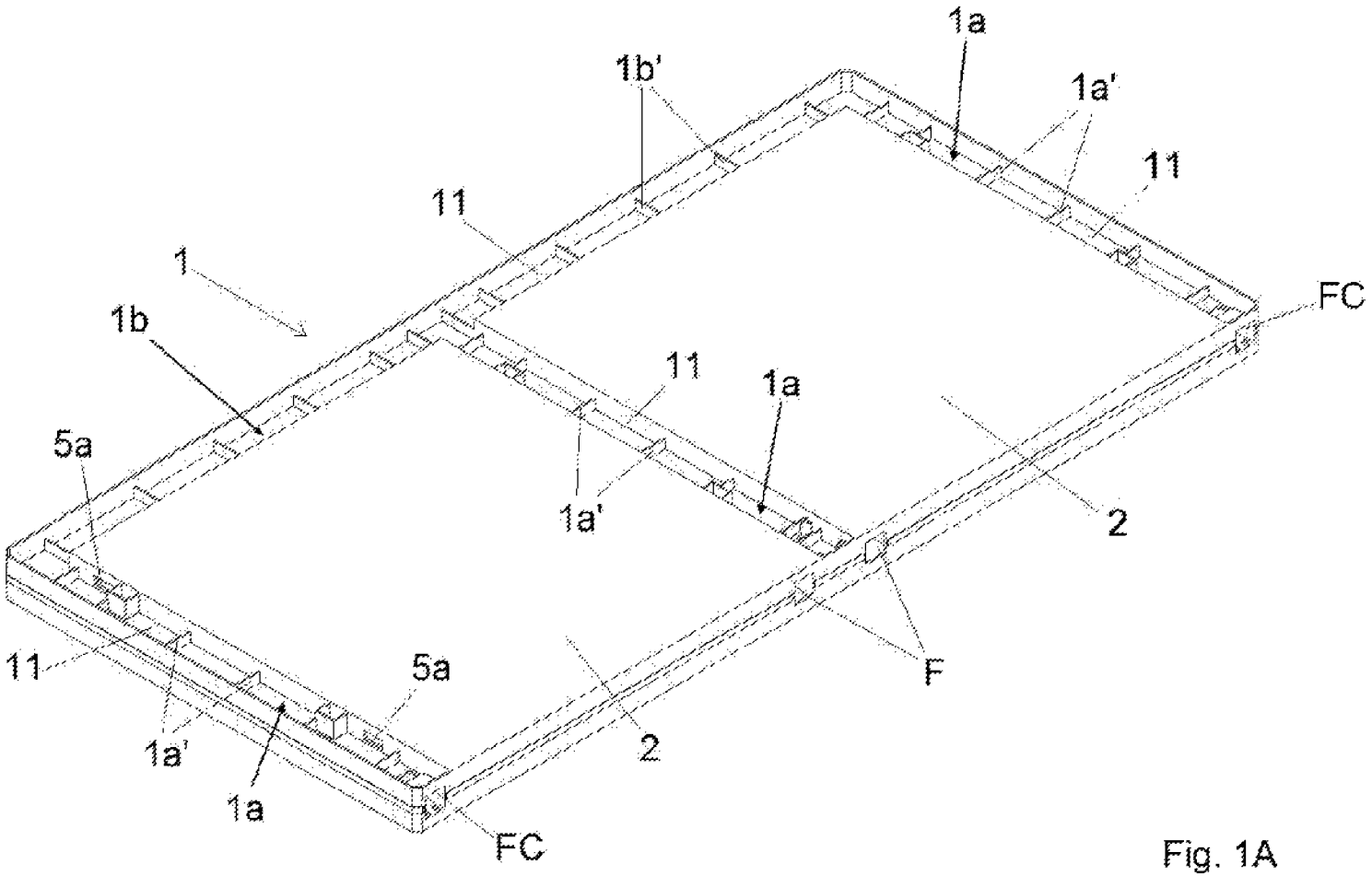
FIG. 1A is an axonometric top view of a horizontal panel of the framework of the invention.
Figure 1B:
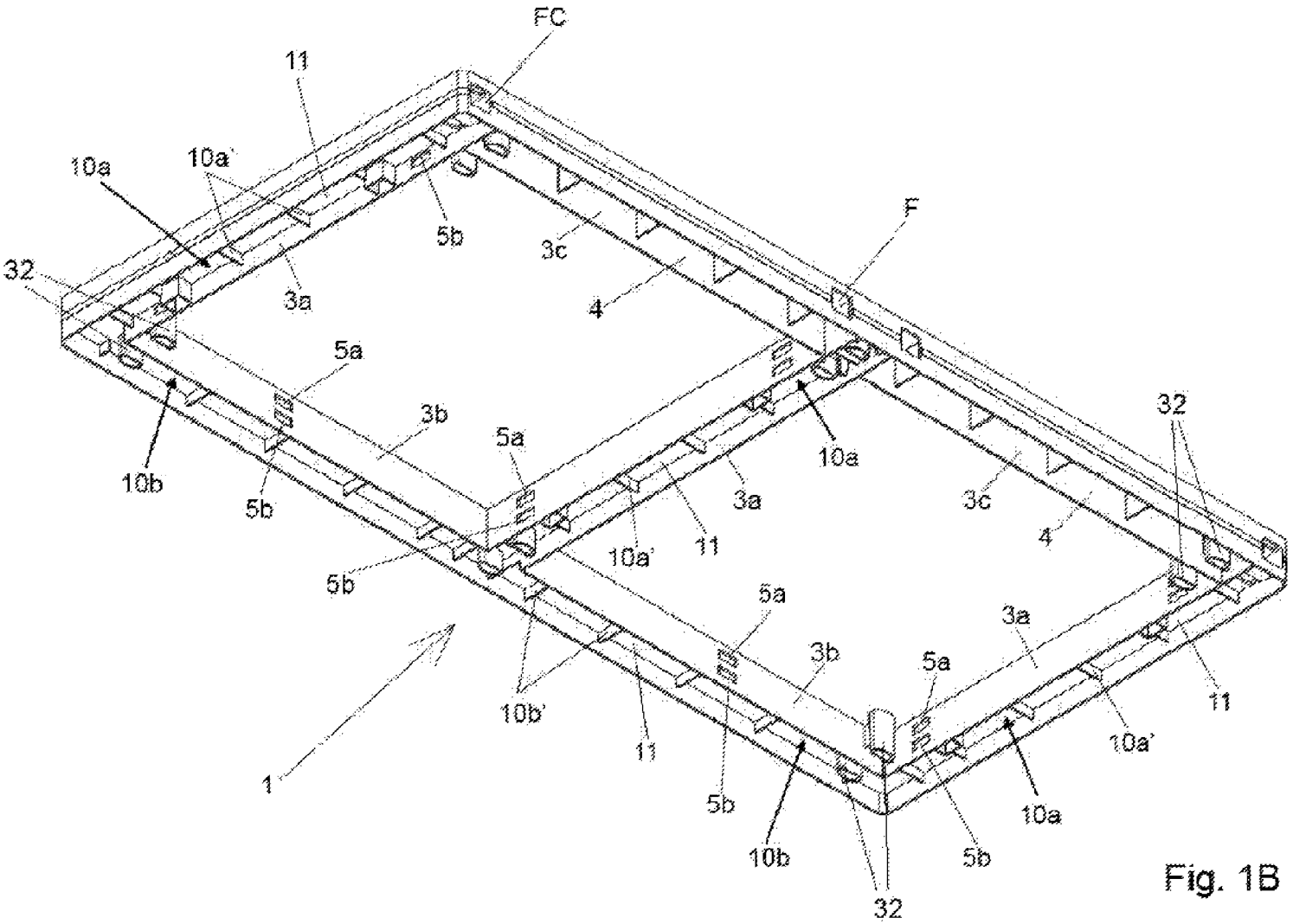
FIG. 1B is an axonometric bottom view of the horizontal panel of FIG. 1A.

Specifically referring to FIGS. 1A and 1B, the first module of the apparatus of the invention is composed of a first boxed quadrangular panel (1) adapted to be mounted in horizontal position in order to act indifferently as bottom or intermediate shelf of a piece of furniture.

As expressly shown in FIG. 1A, the upper surface of said first horizontal panel (1) is characterized in that it is provided with three identical transversal grooves (1*a*) extending from the front to the back; it being provided that two of said grooves (1*a*) are obtained at the height of the lateral edges of the horizontal panel (1) and the third one is obtained in the central line of the latter.

The back ends of said three transversal grooves (1*a*) end inside a longitudinal groove (1*b*), with identical shape and section, obtained at the height of the back edge of the panel (1).

Transversal partitions (1*a*', 1*b*') protrude from the bottom of said grooves (1*a*, 1*b*), being regularly spaced and having height lower than the depth of the grooves receiving them.

The presence of said grooves (1*a*, 1*b*) isolates two large quadrangular portions (2) on the upper face of the horizontal panel (1), having a continuous surface and adapted to act as support surfaces for the objects stored inside the piece of furniture.

As shown in FIG. 1B, which is a bottom view of said panel, the three transversal grooves (1*a*) and longitudinal groove (1*b*) exactly correspond, on the lower surface of said horizontal panel (1), to three transversal grooves (10*a*) and one longitudinal groove (10*b*).

Said four grooves (10*a*, 10*b*) obtained in correspondence of the lower side of said horizontal panel (1) have the same shape and section as the corresponding "upper" grooves (1*a*, 1*b*) and are equally provided with corresponding series of transversal partitions (10*a*', 10*b*') not for their entire depth.

For convenience purposes, said four grooves (1*a*, 1*b*) obtained on the upper side of said first horizontal panel (1) are defined as "upper grooves", and likewise grooves (10*a*, 10*b*) obtained on the lower side of the same horizontal panel (1) are defined as "lower grooves".

It must be noted that the four upper grooves (1*a*, 1*b*) are joined with the corresponding for lower grooves (10*a*, 10*b*) by means of a horizontal partition wall (11) obtained at half all of the thickness of the horizontal panel (1).

A comparison of said FIGS. 1A and 1B shows that, because of the presence of said upper grooves (1*a*, 1*b*) and lower grooves (10*a*, 10*b*), the two quadrangular portions (2) of the upper side of said first horizontal panel (1) are empty on the bottom.

In fact, on the lower side of the panel (1) each portion (2) is defined by two transversal edges (3*a*), one back longitudinal edge (3*b*), and one front longitudinal edge (3*c*) because of the presence of a groove (4) obtained at the height of the front edge of the panel (1) without affecting the upper side of the latter.

The back longitudinal edge (3*b*) is provided, basically in central position, with a pair of slots (5*a*, 5*b*) with horizontal direction, of which the first one (5*a*) lays at height higher than the partition wall (11) situated between said upper grooves (1*a*, 1*b*) and lower grooves (10*a*, 10*b*), whereas the second one (5*b*) lays at height lower than the partition wall (11).

Two pairs of horizontal slots (5*a*, 5*b*) are obtained on each of said transversal edges (5*a*) towards the two ends of the same.

It can be otherwise said that each of said upper grooves (1*a*, 1*b*) is provided, on one of its lateral edges, with one or more specimens of said first slot (5*a*) and each of said lower grooves (10*a*, 10*b*) is provided, on the same lateral edge, with specimens of the second slot (5*b*), in lower position relative to said horizontal wall (11).

Figure 2:
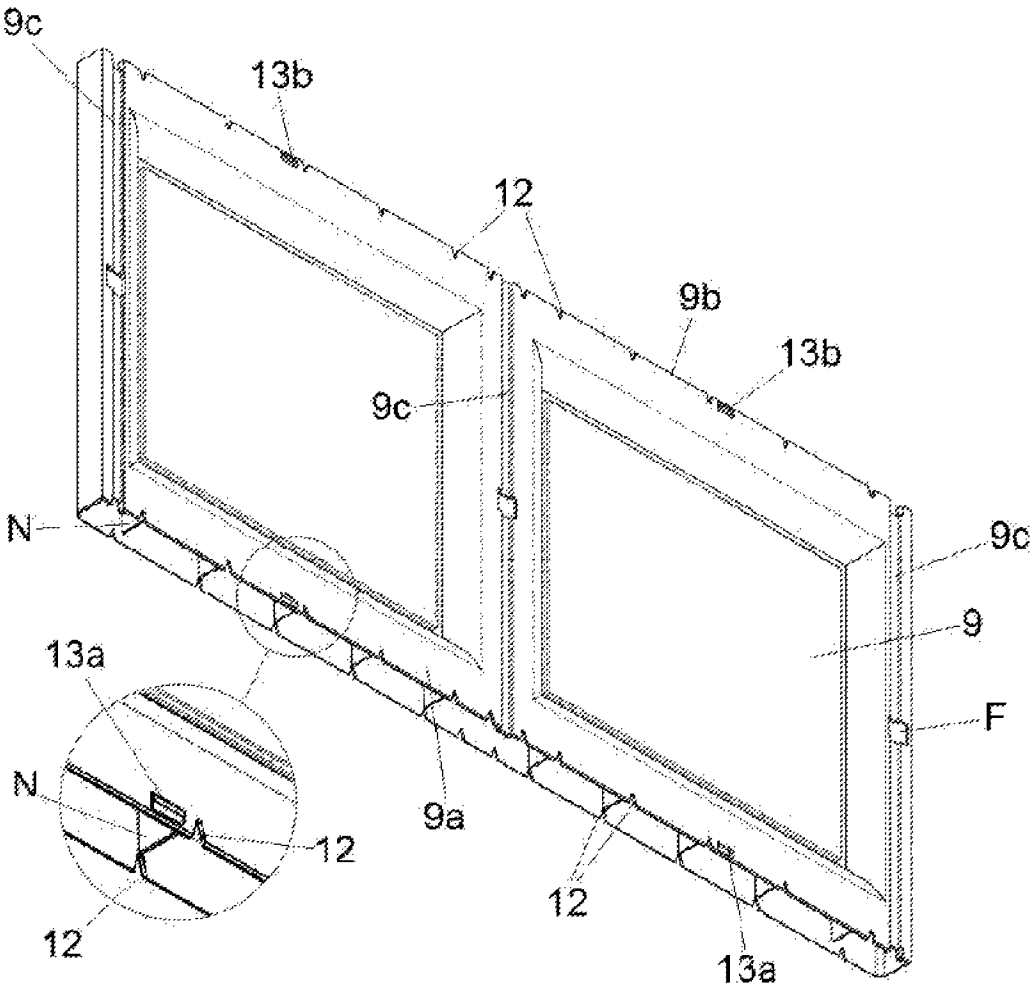
FIG. 2 is an axonometric front view of the back of the apparatus of the invention.

Referring to FIG. 2, the second component of the modular apparatus of the invention consists in an additional boxed quadrangular panel adapted to be mounted in vertical position and be therefore configured as the back (9) of the piece of furniture.

Said back (9) has an empty structure, internally stiffened by as vertical series of transversal ribbing (N).

Opposite pairs of short, basically V-shaped notches are obtained (12) on the lower longitudinal edge (9*a*) and the upper longitudinal edge (9*b*) of the back (9).

As expressly shown in FIG. 2, two pairs of wedge profiles (13*a*, 13*b*) are provided on the internal side of the back (9), it being provided that the first pair of said wedge profiles (13*a*) is situated at the height of said lower longitudinal edge (9*a*) and the second pair of said profiles (13*b*) is situated at the height of said upper longitudinal edge (9*b*).

Additionally, said back (9) is provided on the from side with three vertical grooves (9*c*) adapted to be perfectly aligned with said grooves (1*a*) of the first panel (1) when the two components are mutually coupled.

Figure 13:
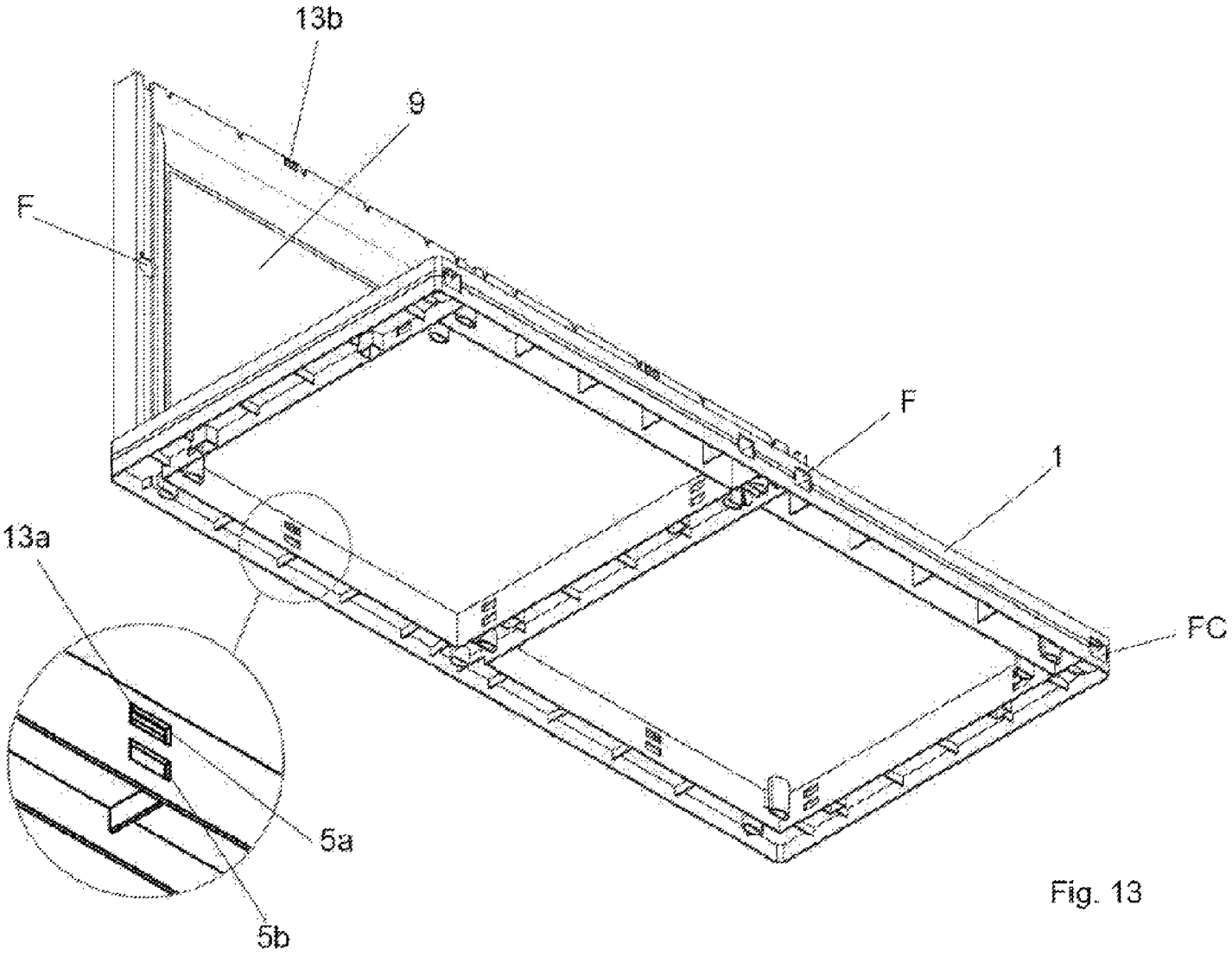
FIG. 13 is an axonometric view of the cooperation modes of a horizontal panel of FIG. 1A with a back of FIG. 2.

In fact, the back (9) is adapted to be coupled with the upper side of said first panel (1), in vertical position on the back longitudinal edge of the panel (1), as expressly shown in FIG. 13.

More precisely, the lower longitudinal edge (9*a*) of the back (9) is exactly inserted into the upper longitudinal groove (1*b*) of the first panel (1).

In view of the above, the back (9) must have the same length as the upper longitudinal edge (1*b*) of the panel (1) and the lower longitudinal edge (9*a*) of the back (9) is adapted to be exactly engaged inside said upper longitudinal edge (1*b*) of the panel (1).

When such insertion is completed, other two important conditions occur, being necessary to stabilize coupling between back (9) and horizontal panel (1).

First of all, reference is made to the fact that said V-shaped notches (12) obtained on the lower longitudinal edge (9*a*) of the back (9) are disposed exactly "astride" said transversal partitions (1*b*') protruding from the bottom of the upper longitudinal groove (1*b*) of the horizontal panel (1).

At the same time, said wedge profiles (13*a*) provided on the internal side of the back (9) on the lower longitudinal edge (9*a*) are fitted inside the slots (5*a*) obtained on the panel (1) at height higher than said partition wall (11) and on the transversal edges (3*b*) that define said continuous portions (2) of the panel (1) in lower and rear position.

It must be noted that fitting of said wedge profiles (13*a*) in the slots (5*a*) is obtained in view of the intrinsic elastic deformation of the plastic material used to make the panel (1) and back (9), and also in view of the considerable strength applied by the operator in charge of assembling the piece of furniture when coupling the lower edge (9*a*) of the back (9) and the upper groove (1*b*) of the horizontal panel (1).

The third component of the apparatus of the invention consists in an additional boxed quadrangular panel, hereinafter defined, as "wall" (14), adapted to be mounted above said first panel (1) as side and internal partition.

Figure 3A:
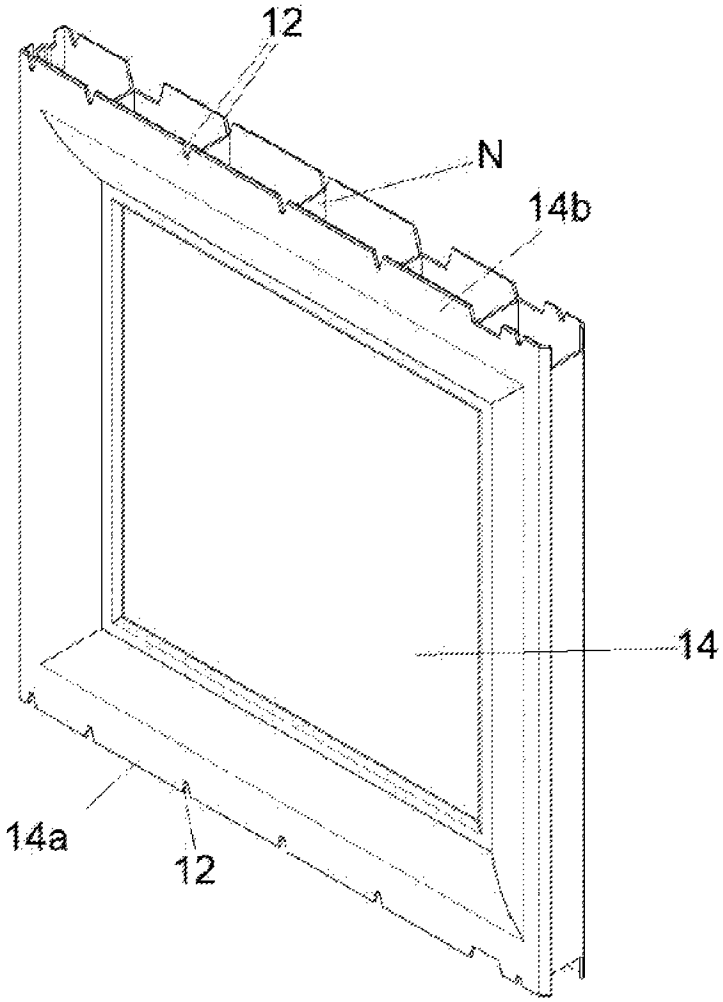
FIG. 3A is an axonometric external view of a vertical panel of the apparatus of the invention.
Figure 3B:
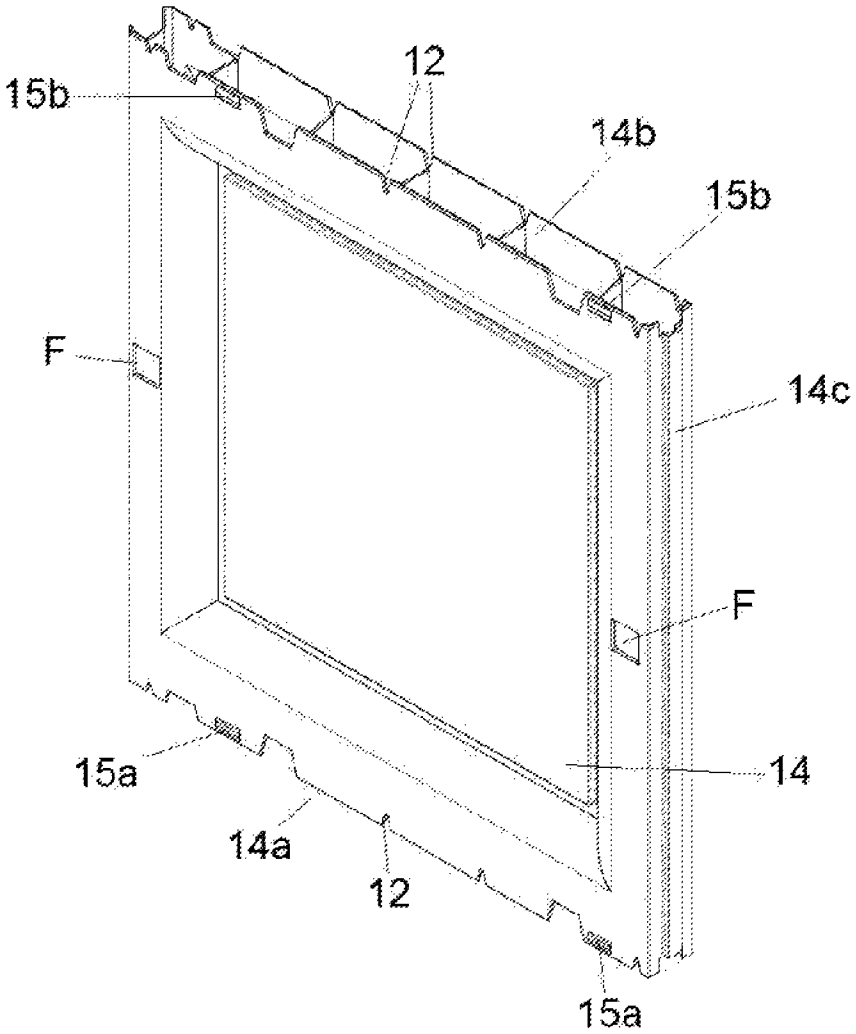
FIG. 3B is an axonometric internal view of the vertical panel of FIG. 3A.

Said wall (14) is illustrated in FIGS. 3A and 3B, which show the internal and external side, respectively.

Just like the back (9), also the wall (14) has an empty structure internally stiffened by a vertical series of transversal ribbing (N).

Both on the lower edge (14*a*) and the upper edge (14*b*), series of opposite pairs of V-shaped notches (12) are provided, as well as two pairs of said wedge profiles (15*a*, 15*b*) respectively disposed on the lower edge (14*a*) and the upper edge (14*b*).

As shown in FIG. 3B, on the rear vertical edge, said wall (14) is provided with a rectilinear rib (14*c*) perfectly compatible with one of said vertical grooves (9*c*) provided on the front of said back (9).

Figure 14A:
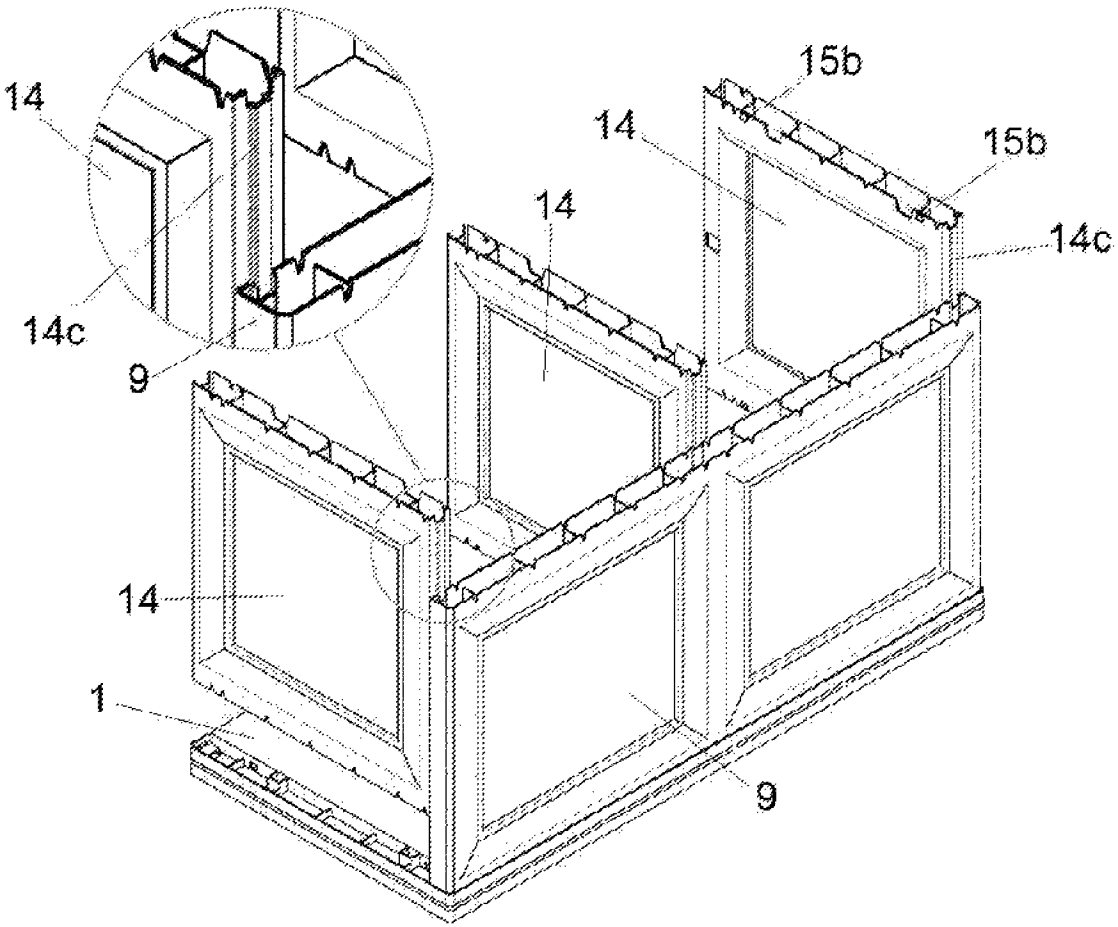
FIGS. 14A and 14B are axonometric views showing the assembly steps of said components of FIG. 13 with three specimens of the vertical panel of FIG. 3A.
Figure 14B:
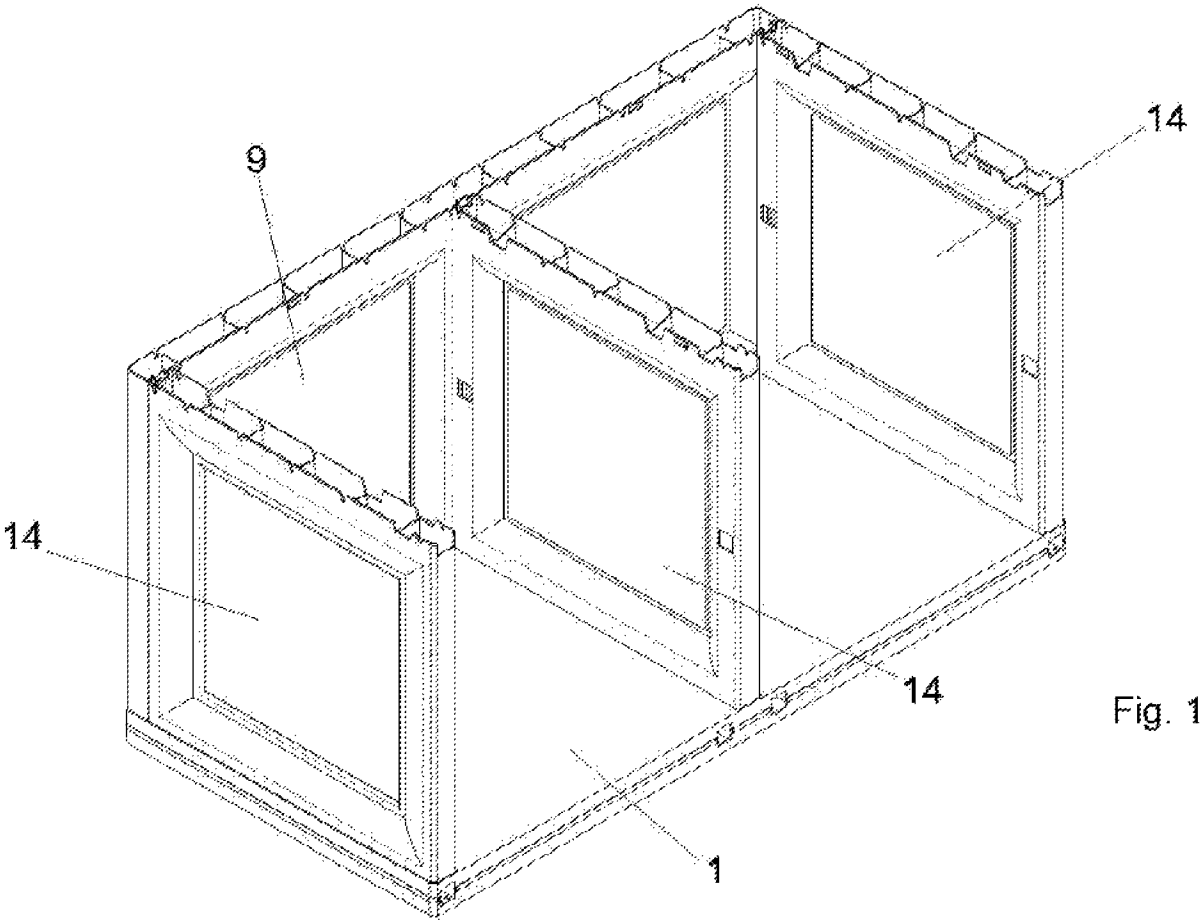

FIGS. 14A and 14B show the destination of the three specimens of said wall (14) after the previous assembly operation consisting in coupling the horizontal panel (1) with the back (9).

As shown in the aforesaid figures, two specimens of said wall (14) act as sides of the piece of furniture and the third specimen acts as internal partition, in intermediate position between the other two specimens.

In order to couple said components, the lower edge (14*a*) of each wall (14) is adapted to exactly engage inside one of the three upper transversal grooves (1*a*) of the first panel (1), in such manner that said V-shaped notches (12) obtained on said lower edge (14*a*) of the wall (14) are exactly disposed "astride" the partitions (protruding from the bottom of the upper transversal groove (1*a*) of the horizontal panel (1).

At the same time, said wedge profiles (15*a*) provided on the internal side of the wall (14) on the lower edge (14*a*) are fitted inside the slots (5*a*) obtained on the first panel (1) at height higher than said partition wall (11) and on the longitudinal edges (3*b*) that define said continuous portions (2) of the panel (1) in lower and rear position.

Evidently, mutual coupling is favored, in terms of perfect centering, by the exact insertion of the rear vertical rib (14*c*) of each wall (14) into the corresponding groove (9*c*) provided on the front of the back (9).

The fourth component of the apparatus of the invention consists in an additional boxed quadrangular panel adapted to act as top (16) of the piece of furniture.

Figure 4A:
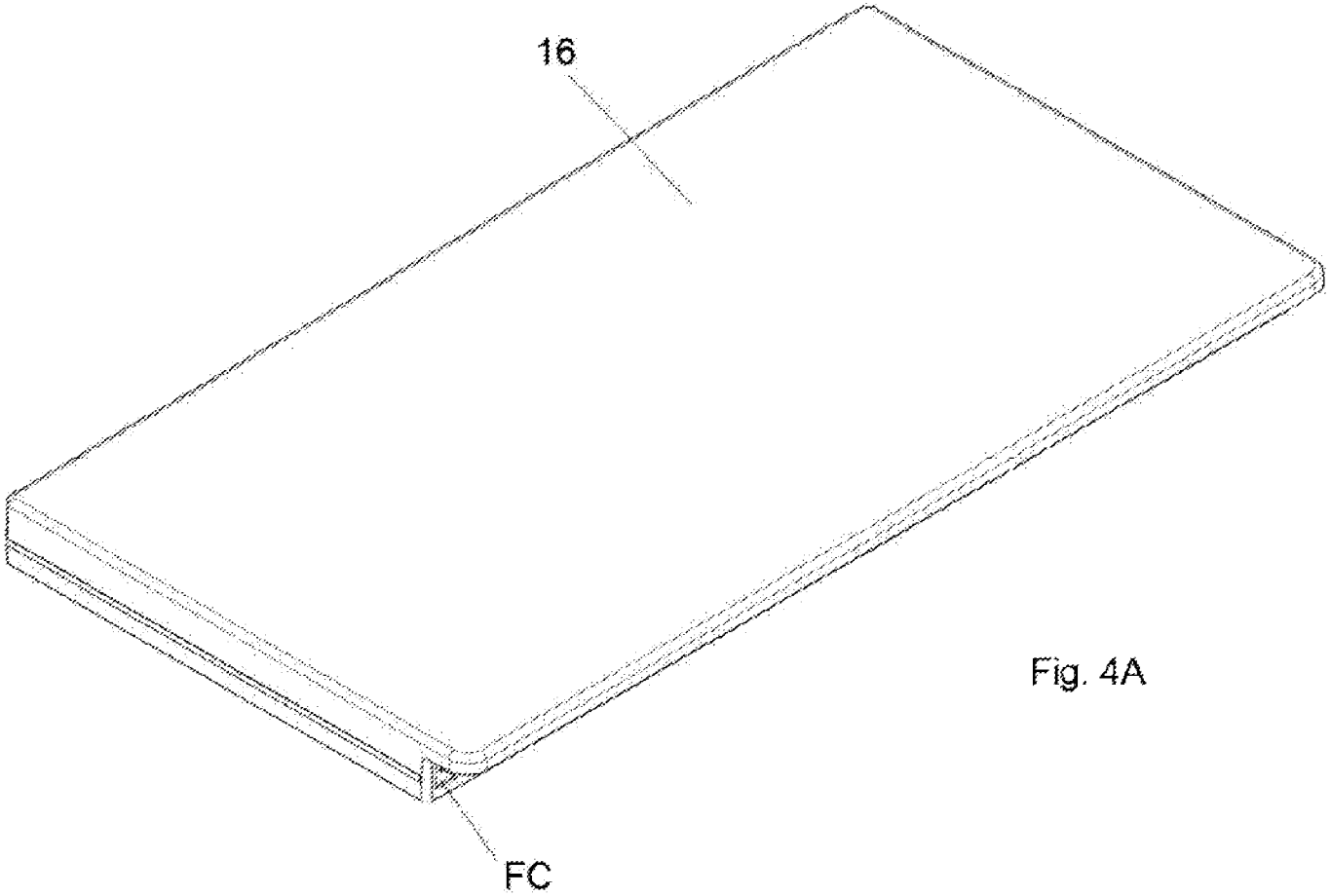
FIG. 4A is an axonometric top view of the top of the apparatus of the invention.
Figure 4B:
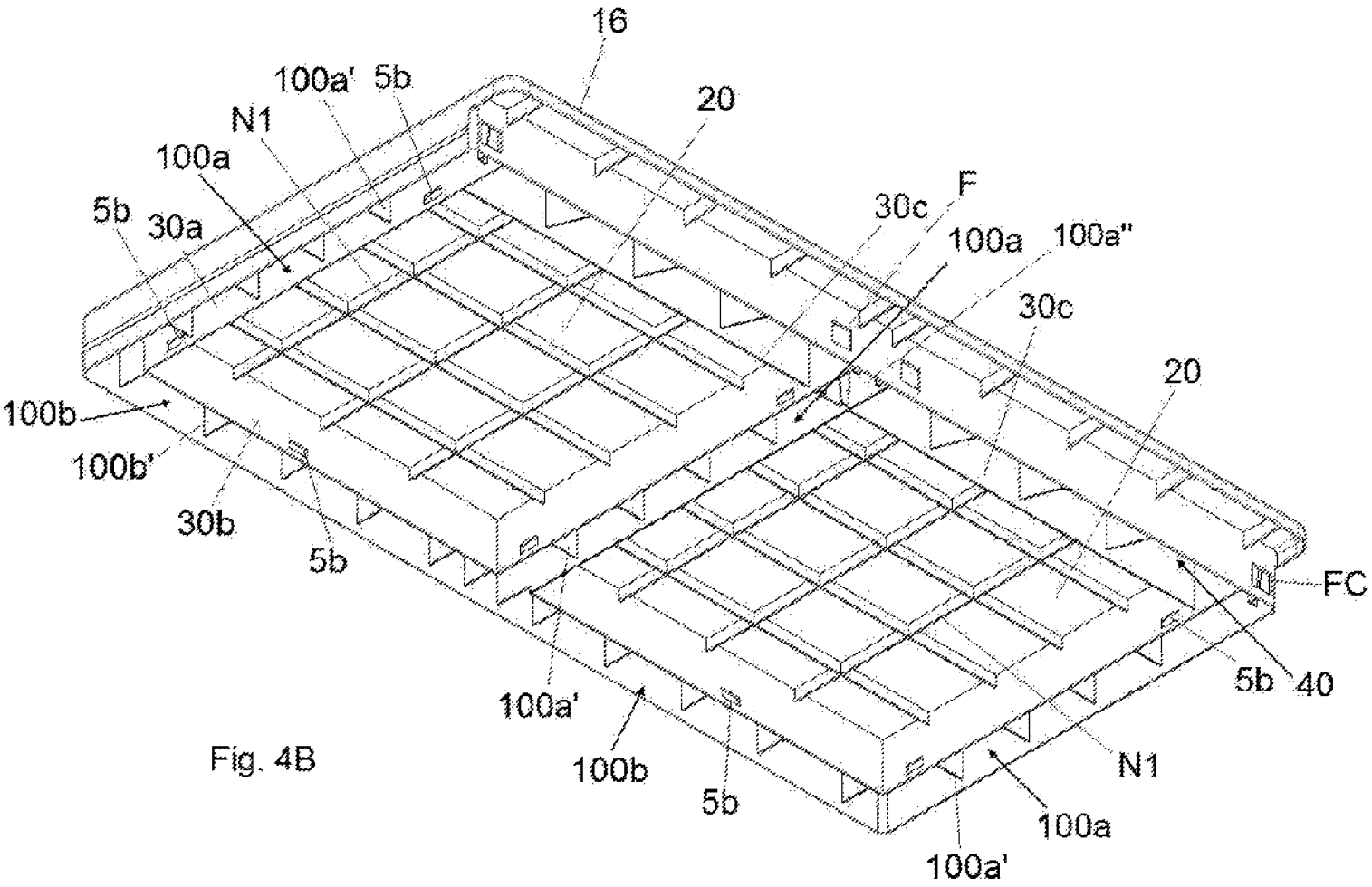
FIG. 4B is an axonometric bottom view of the top of FIG. 4A.

FIGS. 4A and 4B expressly show the top (16), respectively showing the perfectly smooth, upper side and the boxed lower side with strongly irregular structure. Moreover, it must be noted that the upper side of said top (16) slightly protrudes with respect to the lower side.

It can be said that the lower side of said top (16) has a configuration that basically corresponds to the lower side of said first panel (1) that acts in horizontal position as bottom and shelf of the furniture piece.

Said top (16) comprises:

- a rear longitudinal groove (100*b*), from the bottom of which a regularly spaced series of vertical partitions (100*b*') protrudes;
- a front longitudinal groove (40);
- a set of three transversal grooves (100*a*) joined with said rear longitudinal groove (100*b*), each of them being provided on the bottom with a corresponding set of vertical partitions (100*a*');
- two large, basically square portions (20) stiffened by ribbing (N1), each of them being deigned by two transversal edges (30*a*), a rear longitudinal edge (30*b*) and a front longitudinal edge (30*c*); it being provided that said rear longitudinal edge (30*b*) has one central slot (5*b*) disposed in horizontal position and each of said transversal edges (30*b*) has two specimens of said slots (5*a*) towards the ends.

Figure 15:
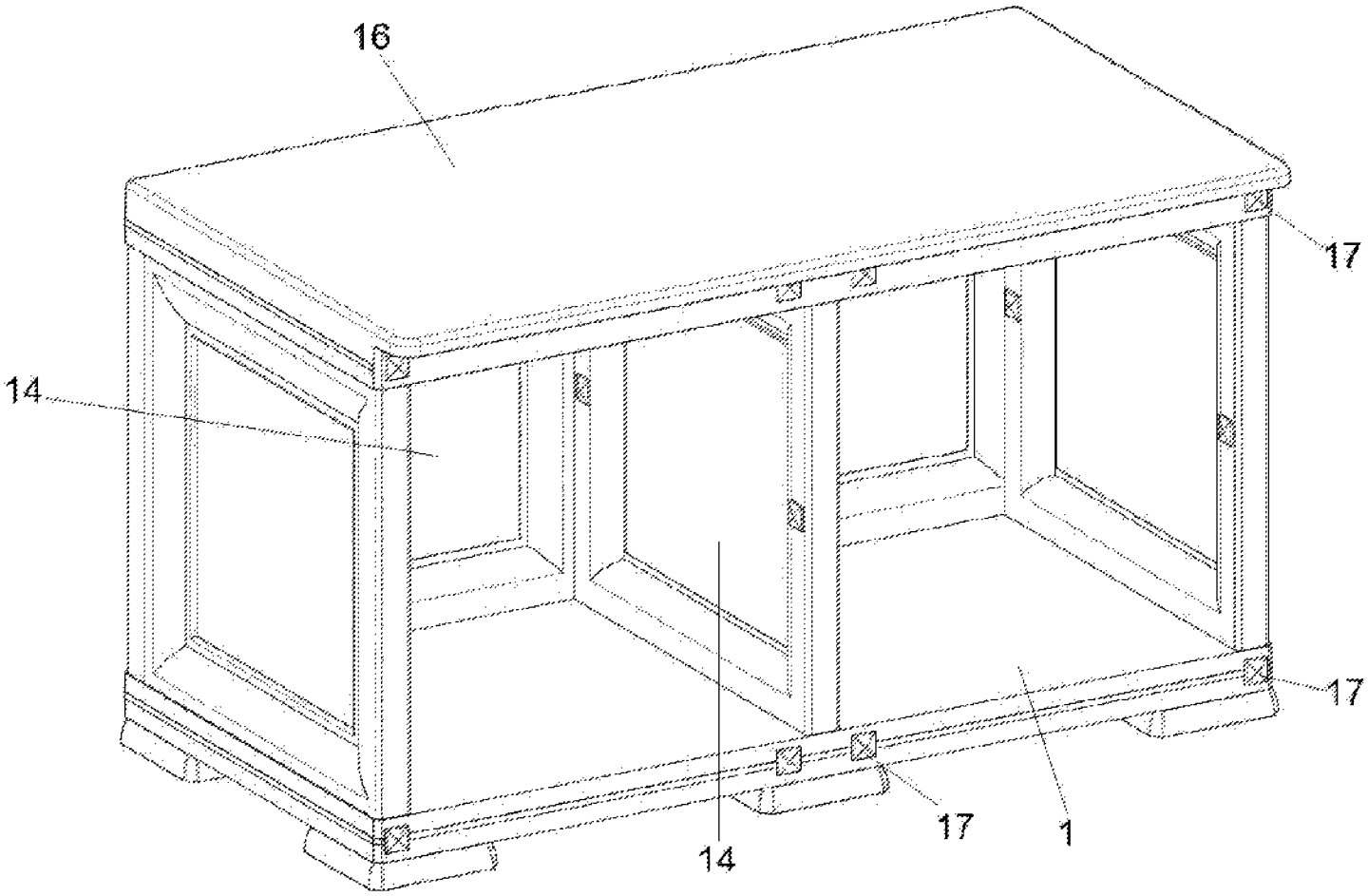
FIG. 15 is an axonometric view of the cooperation modes of the top of FIG. 4A with the components of FIG. 14B, in assembled condition.

FIG. 15 shows the installation of the top (16) in order to complete the composition of a piece of furniture with the configuration shown in the preceding FIG. 14B.

The top (16) is inserted from up down, in such manner that the upper edge (9*b*) of the back (9) is exactly inserted in the rear longitudinal groove (100*b*) and the upper edges (14*b*) of the three walls (14) are exactly inserted in the transversal grooves (100*a*).

During such coupling, the pairs of V-shaped notches (12) obtained on the upper edge (9*b*) of the back (9) are conjugated with the transversal partitions (100*b*') provided inside the rear longitudinal groove (100*b*) of the top (16) and the pairs of V-shaped notches (12) obtained on the upper edge (14*b*) of each wall (14) are conjugated with the transversal partitions (100*a*') provided inside the transversal groove (100*a*) of the top (16).

Such coupling is additionally stabilized because, on one side, the wedge profiles (13*b*) obtained in internal position on the upper longitudinal edge (9*b*) of the back (9) penetrate the slots (5*a*) provided on the rear longitudinal edges (30*b*) that define the two large portions (20) of the lower side of the top (16) and, on the other side, the wedge profiles (15*b*) obtained in internal position on the upper edge (14*b*) of each wall (14) penetrate the slots (5*a*) provided on the transversal edges (30*a*) that define the two portions (20) of the lower side of the top (15).

Figure 16A:
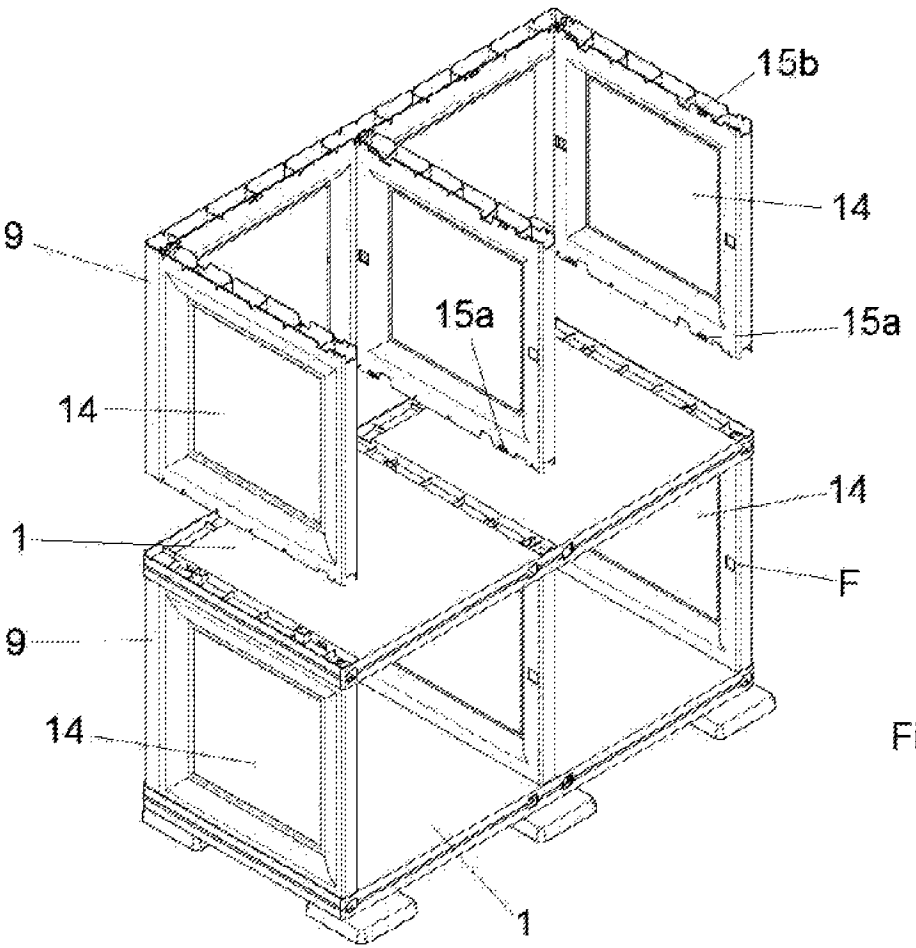
FIGS. 16A and 16B are axonometric views showing the assembly steps of a piece of furniture obtained with the components of the apparatus of the invention.
Figure 16B:
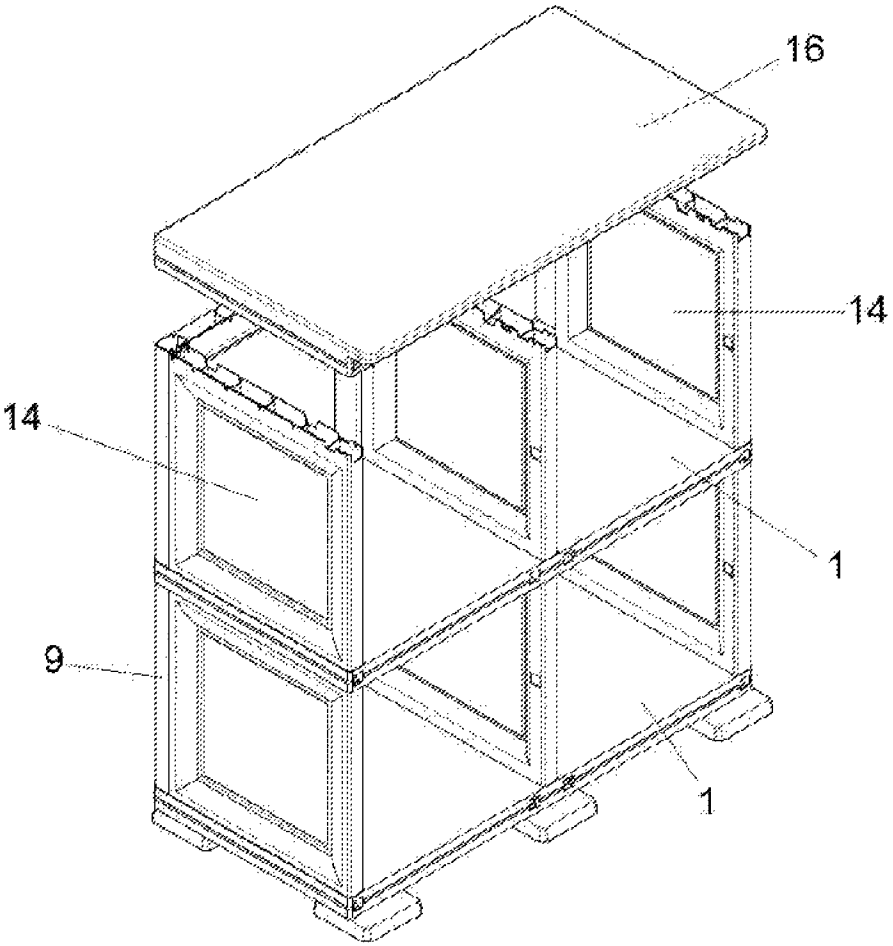

Referring to FIGS. 16A and 16B, the apparatus of the invention can be also used to realize a piece of furniture with multiple shelves.

In such a case, after coupling a specimen of the horizontal panel (1), the back (9) and three specimens of the wall (14), as shown in FIG. 14B, the structure must be dosed on top with an additional specimen of said horizontal panel (1) that acts as shelf, in this case, as shown in FIG. 16A.

Such mounting can be obtained as long as the top edges of said hack (9) and walls (14) are exactly engaged into said lower grooves (10*a*, 10*b*) obtained in the lower side of said horizontal panel (10) acting as shelf.

In particular, the upper edge (9*b*) of the back (9) must be inserted into the rear longitudinal groove (10*b*) of the lower side of said first panel (1), whereas the upper edges (14*b*) of the three walls (14) must be inserted into the three transversal grooves (10*a*) of the lower side of the panel (1).

Moreover, said coupling guarantees the exact conjugation of said V-shaped notches (12) provided on the top of the back (9) and the three vertical walls (14) with said partitions (10*a*', 10*b*') respectively provided, on the three transversal grooves (10*a*) and the rear longitudinal groove (10*b*) provided on the lower side of said first panel (1) acting as shelf.

At the same time, the wedge profiles (13*b*) provided in internal position on the upper edge (9*b*) of the back (9) are fitted into the slots (5*b*) that, within said longitudinal edges (3*b*) protruding from the lower side of the first panel (1) acting as shelf, are disposed under said horizontal partition (11).

Likewise, the two wedge profiles (15*b*) provided at the height of the upper edge (14*b*) of each vertical wall (14) are fitted into corresponding slots (5*b*) obtained, under said horizontal partition (11), on the transversal edges (3*a*) protruding from the lower side of the panel (1).

Referring to FIG. 16B, the upper side of said first panel (1), acting as shelf, is coupled with a back (9) and three specimens of the vertical wall (14).

This operation is carried out according to the installation modes illustrated with reference to FIGS. 14A and 14B, illustrating the coupling between the upper side of the first panel (1) acting as bottom with the back (9) and three walls (14).

FIG. 16B also illustrates the presence of a top (16) used to close the piece of furniture on top, according to the installation modes illustrated with reference to FIGS. 4B, 14A, 14B and 15.

Figure 17:
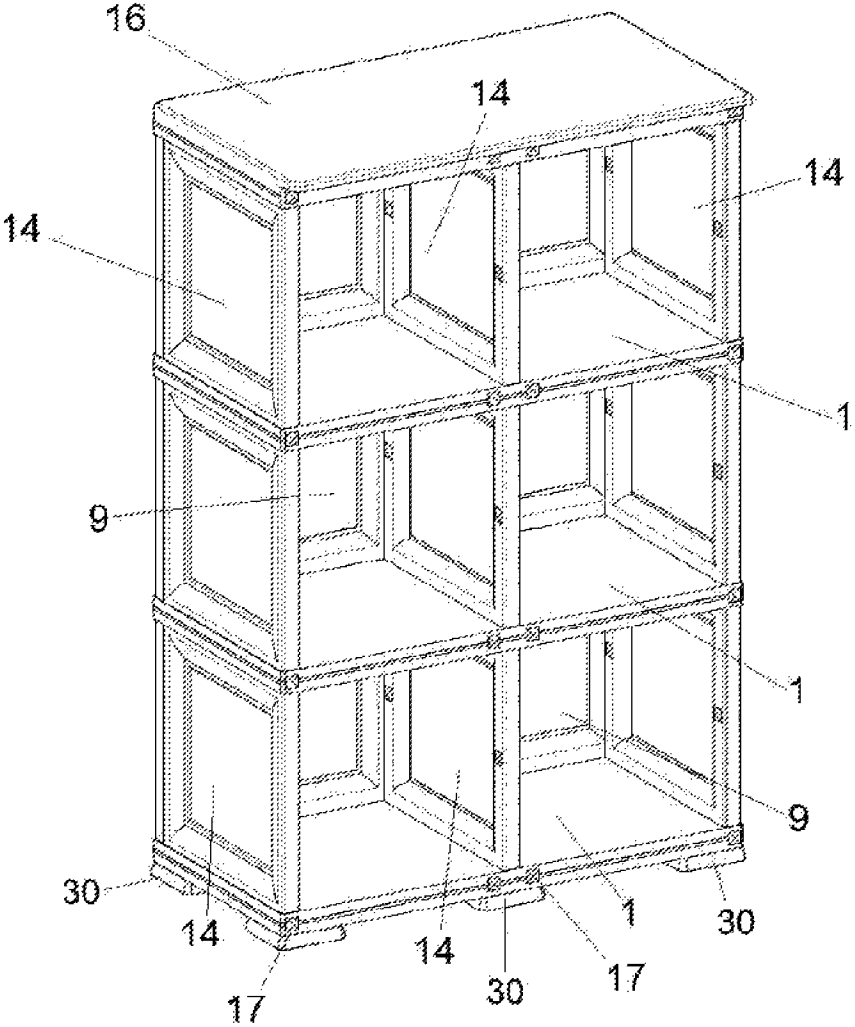
FIG. 17 is an axonometric view of an additional piece of furniture without doors, obtained by suitably assembling the components of the apparatus of the invention.

Evidently, by combining a suitable number of said modular components (1, 3, 14), a piece of furniture with a higher number of shelves than the one shown in FIG. 16*b* can be realized; for illustrative, not limiting purposes, reference is made to FIG. 17.

Referring to the aforesaid figures, it must be noted that all components of the apparatus of the invention are provided, for fabrication requirements, with square holes (F, FC) that certainly tend to jeopardize aesthetics.

Figure 12C:
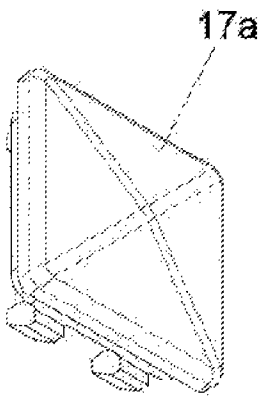
FIGS. 12A, 12B and 12C are three axonometric perspective views showing an end cap of the apparatus of the invention.
Figure 12B:
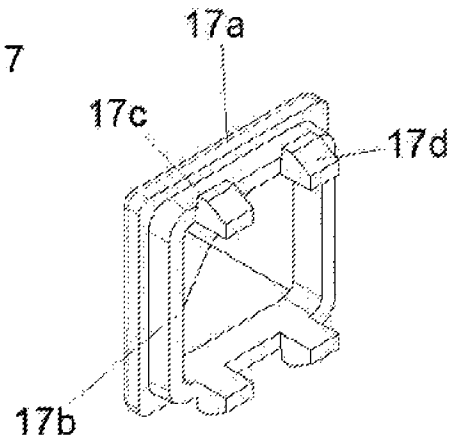
Figure 12A:
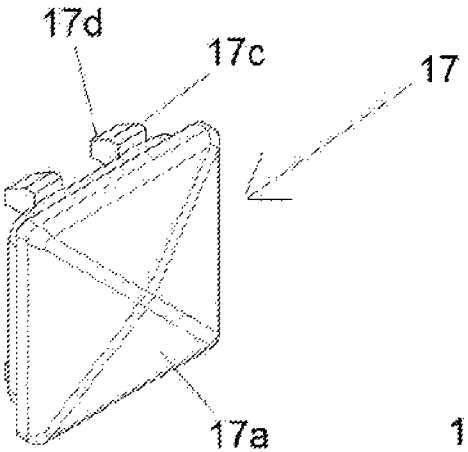

For this reason, the additional component of the modular apparatus of the invention consists in the cap (17) shown in FIGS. 12A, 12B and 12C. The function of said cap (17) is to close said square holes (F, FC), as shown in FIGS. 15 and 17.

In particular, the cap (17) is provided with an empty pyramidal head (17*a*) with square base, the rear opening of which is defined by a basically square edge (17*b*) from which two opposite pairs of hook-shaped teeth (17*c*) partially protrude in external position on the square edge (17*b*), having a tilted profile (17*d*) converging towards the center of the cap (17).

Moreover, said square edge (17*b*) is shaped and dimensioned in such manner to be exactly inserted into one of said holes (F, FC).

Such an insertion, however, can be obtained on condition that the two pairs of teeth (17*c*) are brought in close position, since the distance between them is higher than the width of the hole (F).

The two pairs of teeth (17*c*) are brought in close position by energetically pushing the cap (17) inside the hole (F), in such manner that the interference generated between the opening edge of the latter and the front tilted profiles (17*d*) of the teeth (17*c*) cause a reduction of the distance provided in idle condition between the two opposite pairs of teeth (17*c*), thus making insertion in the hole (F) possible.

Because of the intrinsic elasticity of the plastic material used for the cap (17), as soon as they pass the opening of the hole (F, FC), the four teeth (17*c*) suffer a spring back effect, meaning that they are separated again and fitted on the back of the opening of the hole (F, FC), thus preventing the accidental detachment of the cap (17).

Figure 18:
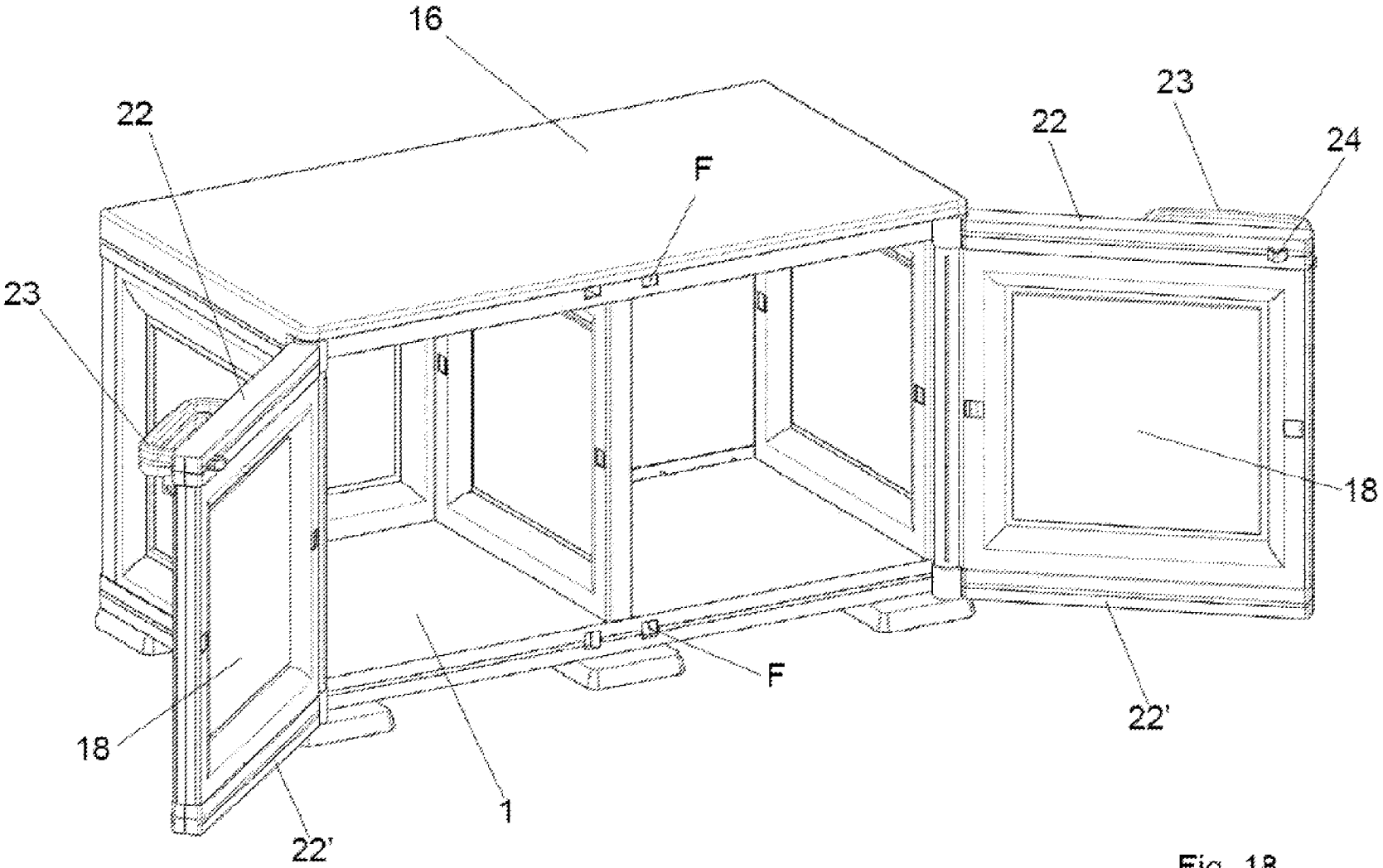
FIG. 18 is an axonometric view of an additional piece of furniture without doors, obtained by suitably assembling the components of the apparatus of the invention.

Within such an innovative technology, it is also possible to make pieces of furniture with doors, as shown in FIGS. 18 and 19.

Figure 5A:
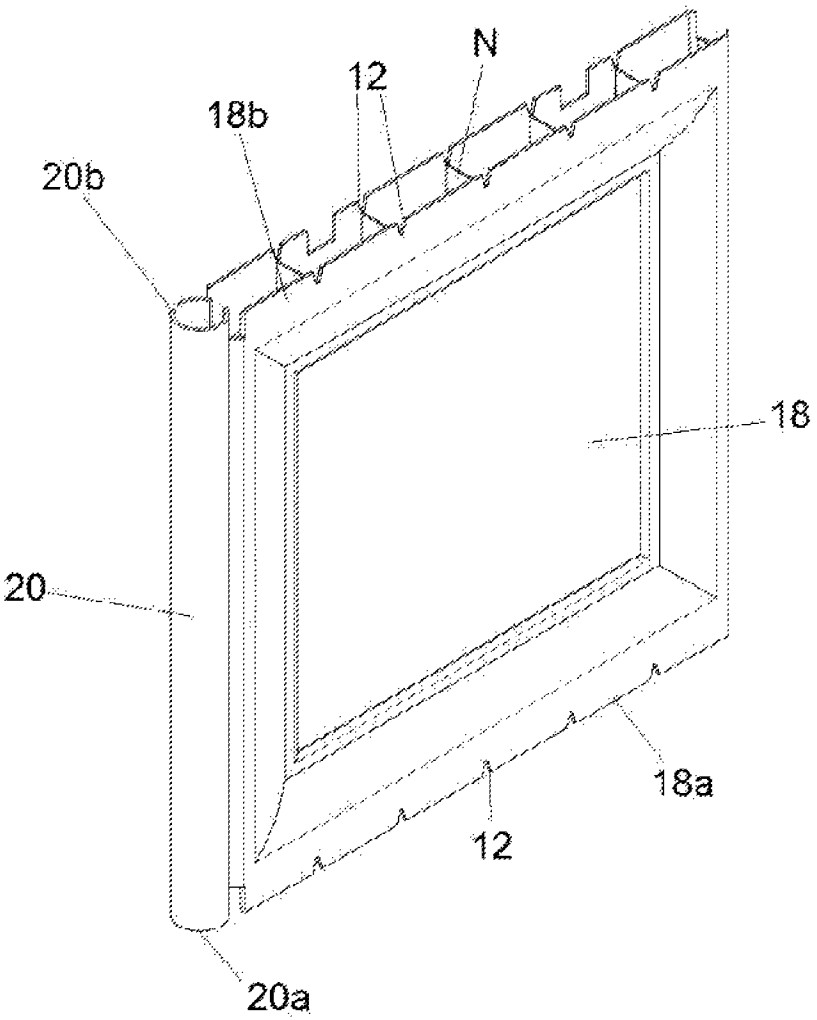
FIG. 5A is an axonometric external view of the door of the apparatus of the invention.
Figure 5B:
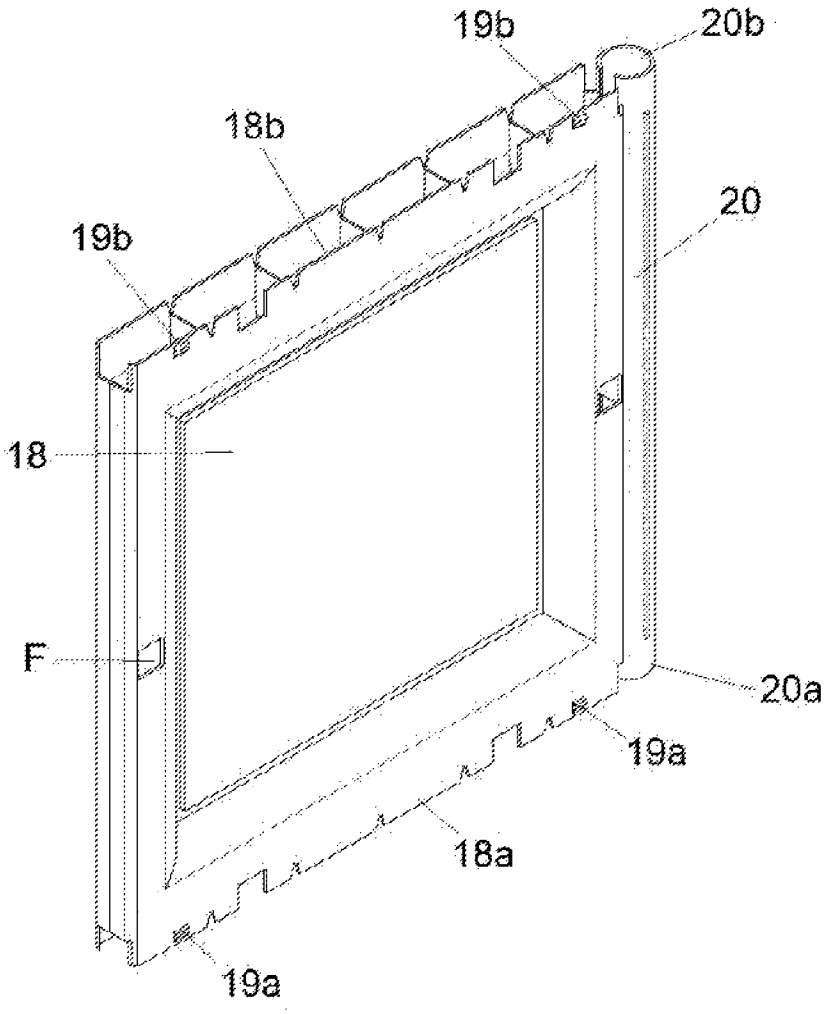
FIG. 5B is an axonometric internal view of the door of FIG. 5A.
Figure 6C:
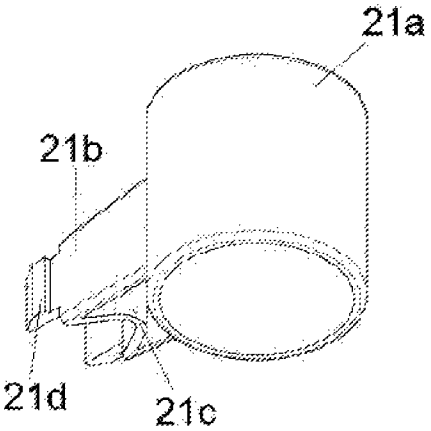
FIGS. 6A, 6B and 6C are three axonometric perspective views showing the hinge for doors of the apparatus of the invention.
Figure 6B:
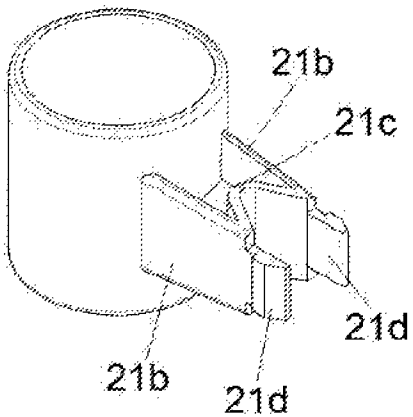
Figure 6A:
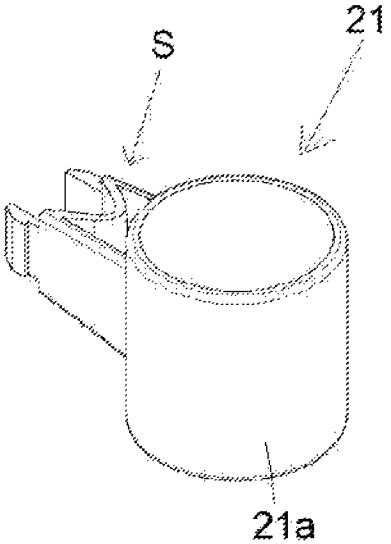

In order to realize such a solution, the apparatus of the invention is provided with two additional components, respectively consisting in the door (18) shown in FIGS. 5A and 5B and the hinge (21) shown in FIGS. 6A, 6B and 6C.

Referring to FIGS. 5A and 5B, the door (18) consists in a boxed panel internally stiffened by a vertical series of transversal ribbing (N), basically having the same shape and dimensions as the wall (14).

Opposite pairs of basically V-shaped notches are obtained (12) on the lower (18*a*) and upper (18*b*) edge of the door (18).

As shown in FIG. 5B, the internal side of said door (18) is provided with a first pair of wedge profiles (19*a*) at the higher of said lower edge (18*a*) and a second pair of wedge profiles (19*b*) at the height of said upper edge (18*b*).

Said V-shaped notches (12) and wedge profiles (19*a*, 19*b*) of the door (18) have the same shape, position and size as the corresponding notches and wedge profiles illustrated with reference to the previous components of the apparatus of the invention.

The peculiarity of the door (18) is the presence, on one of the vertical edges, of a tubular cylindrical profile (20), the lower (20*a*) and upper (20*b*) end of which are respectively disposed at the height of said lower (18*a*) and upper (18*b*) edge of the door (18), while being separated by a certain distance.

The component designed to cooperate with said door (18) consists in the hinge (21) expressly shown in FIGS. 6A, 6B and 6C.

Said hinge (21) is formed of a cylindrical sleeve (21*a*) that supports a radial plug (S) in external position, composed of two converging arms (21*b*) connected at the end by an elastically compressible V-shaped bridge (21*c*), it being provided that each of said arms (21*b*) is provided at the end with a tooth (21*d*) in parallel position to the axis of said sleeve (21*a*).

In view of the above, the installation mode of the door (18) in the piece of furniture can be illustrated.

The first operation is the insertion of the sleeve (21*a*) of a first specimen of hinge (21) on the outside of the lower end (20*a*) of said vertical cylindrical profile (20) of the door (18) and the sleeve (21*a*) of a second specimen of the same hinge (21) on the outside of the upper end (20*b*) of the same vertical cylindrical profile (20); such a condition is shown in FIG. 19.

The second operation is the forced insertion of the plugs (S) of the two hinges (21) now coupled with the door (18) inside square holes (FC) frontally provided at the ends of said first panel (1), acting as bottom and shelf, as well as at the ends of the top (16); the presence of said holes (FC) is shown in FIGS. 1A and 4B.

It must be noted that, in idle position, each of said plugs (S) has volume higher than the inlet section of the hole (FC).

However, also in such a case, the insertion of the plug (S) in the hole (EC) is obtained by taking advantage of the interference created between said front hooks (21*d*) protruding on the two sides of the plug (S) and the vertical edges of the hole (FC).

Such an interference, which can be overcome by exerting a suitable force during the insertion of the plug (S), causes the compression of said elastic bridge (21*c*) connecting said two arms (21*b*) of the plug (S), this bringing them closer.

Such a temporary thinning of the plug (S) makes its insertion in the hole (FC) possible.

Evidently, said plug (S) tends to return to its normal condition spontaneously and suddenly, as soon as the front hooks (21*d*) have passed beyond the vertical edges of the hole (FC) and mutual interference has ceased.

In such a condition, the elastic bridge (21*c*) tends to recover its normal position, the two arms (21*b*) are separated again and the hooks (21*d*) are fitted in internal position on the vertical edges of the hole (FC), thus preventing the accidental uncoupling of the hinge (21) from the piece of furniture.

The apparatus of the invention comprises two additional components adapted to cooperate with the door (18) illustrated above in order to finish the upper and lower edge of the same.

Figure 7A:
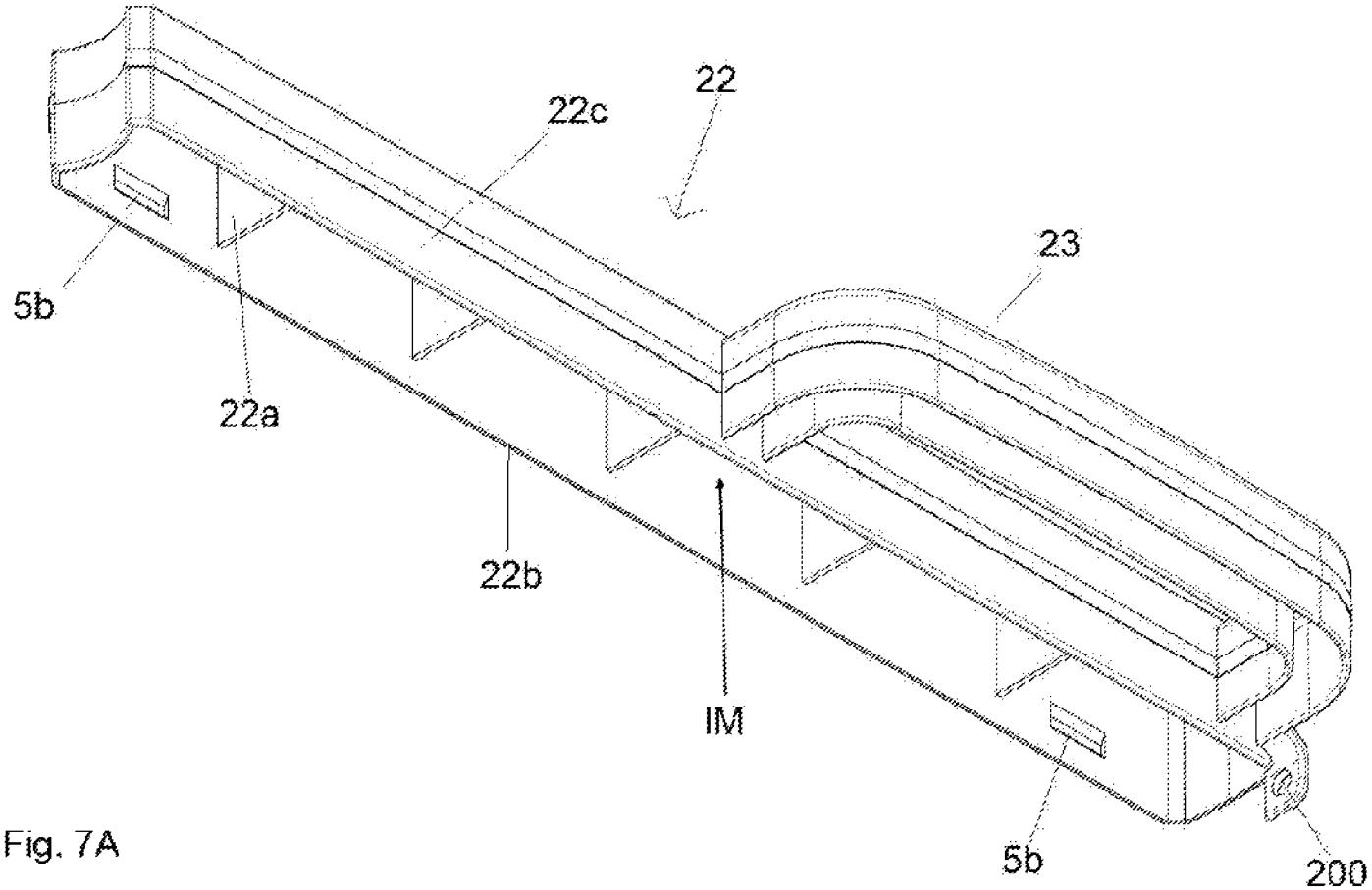
FIG. 7A is an axonometric bottom view of a first strip with handle of the apparatus of the invention.
Figure 7B:
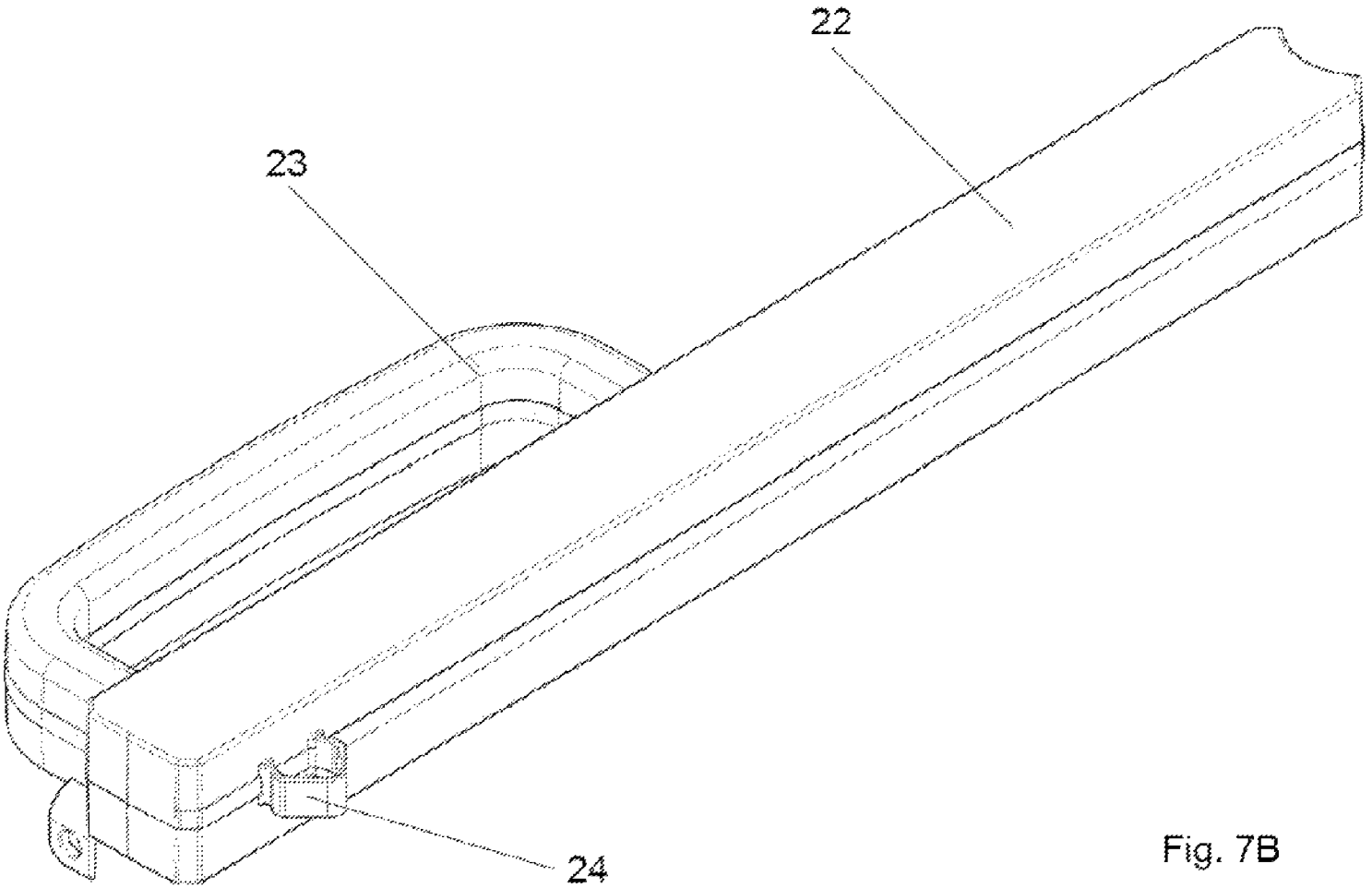
FIG. 7B is an axonometric top view of the strip of FIG. 7A.

Referring to FIGS. 7A and 7B, the first finishing component consists in a boxed strip (22) provided with a lateral handle (23) at the front end.

Said strip (22) is provided with one mouth (IM) for the exact insertion, inside the strip (22), of one of said lower (18*a*) and upper (18*b*) edge of a door (18).

Such a strip (22), which is hereinafter defined as "first finishing, strip" (22), must be preferably coupled with the upper horizontal edge (18*b*) of the door (18), in order to provide, in external position on the furniture piece, a handle (23) used to open and close the door (18), as shown in FIG. 18.

As shown in FIG. 7A, said first finishing strip (22) is internally provided with transversal partitions (22*a*) connecting the first (22*b*) and second (22*c*) longitudinal edge; it being also provided that the first (22*b*) of said vertical edges is provided, towards the longitudinal ends, with two horizontal slots (5*b*), of the type illustrated for the previous components of the apparatus of the invention, whereas the second longitudinal edge (22*c*) externally supports said handle (23).

In order to mount such a first finishing strip (22) on top of the door (18), the upper edge (18*b*) of the door (18) is inserted inside the strip, using said mouth (IM), thus obtaining the usual coupling between said pairs of notches (12) provided on the edge (18*b*) and said partitions (22*a*) provided in internal position on said first finishing strip (22).

At the same time, an additional consequence occurs, meaning the fitting of said wedge profiles (19*b*) provided, in internal position on the upper edge (18*b*) of the door (18) inside the slots (5*a*) provided on said first longitudinal edge (22*b*) of the first finishing strip (22).

As shown in FIG. 18, said first finishing strip (22) is provided, in external position on the first edge (22*b*), with a basically omega-shaped projection with elastically deformable structure, adapted to be forcedly inserted into one of said holes (F) provided on the front of the top (16) of the piece of furniture when the door (18) is closed.

Said projection (24) is adapted to stabilize the door (18) in closing position; it being provided that a sufficient energetic traction of said door (18) allows to extract the projection (24) from the hole (F) in order to open the door (18).

Figure 19A:
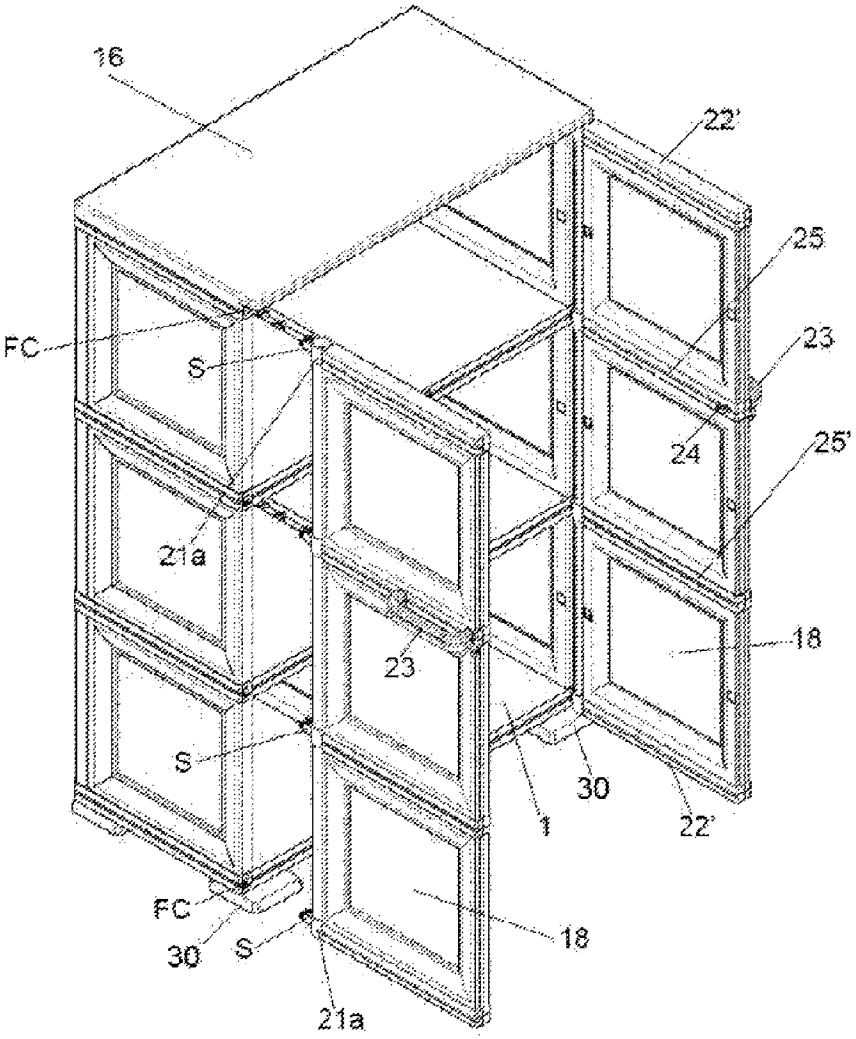
FIGS. 19A and 19C are axonometric views of a piece of furniture with doors and three shelves, obtained by suitably assembling the components of the apparatus of the invention.
Figure 19B:
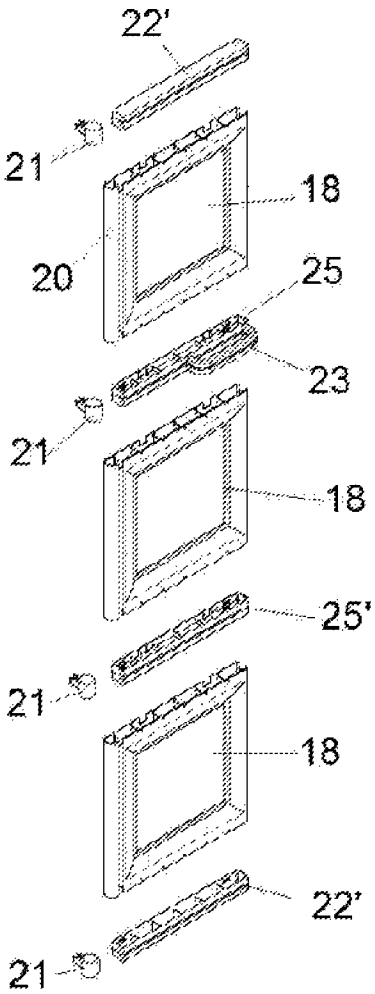
FIG. 19B is an exploded axonometric view of one of the doors provided in the piece of furniture shown in FIGS. 19A and 19C.
Figure 19C:
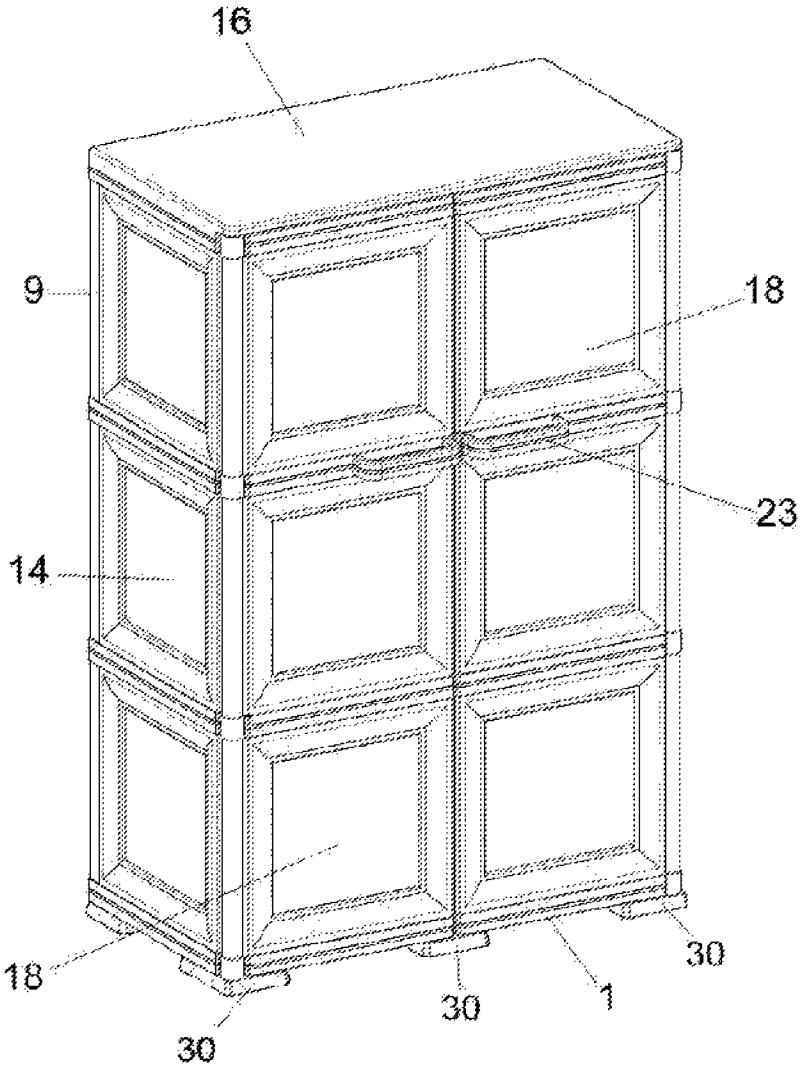

The holes (F) adapted to receive the omega-shaped projection (24) are also provided on the front edge of each specimen of the panel (1), in order to stop the door (18) also when the omega-shaped projection (24) is disposed in front of a specimen of said panel (1), as shown in FIGS. 19A, 19B and 19C.

As shown in FIG. 1A, just like the top (16), on the front longitudinal edge, the first panel (1) is provided with four specimens of said square holes, of which two (FC) towards the ends of the front edge and two (F) in symmetrical position in the proximity of the central transversal groove (1*a*) on the two sides of the same.

Figure 8:
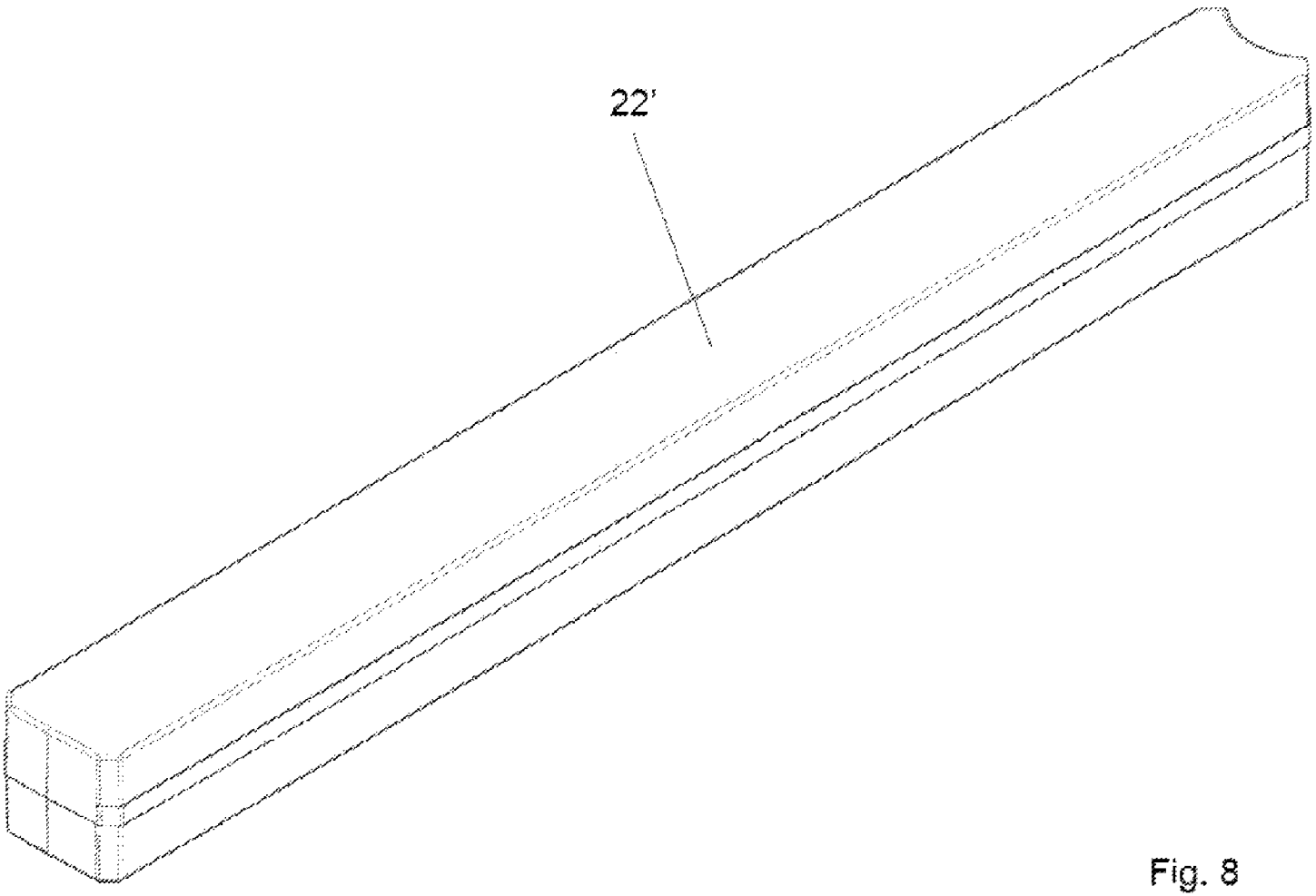
FIG. 8 is an axonometric bottom view of a first strip without handle of the apparatus of the invention.

The additional component adapted to cooperate with the door (8) is a second boxed finishing strip (22') shown in FIG. 8. Said second finishing strip (22') is exactly the same as the strip (22) shown in FIGS. 7A and 7B, with the only difference that it is not provided with handle (23).

FIG. 18 shows the presence of two specimens of said second strip (22') on the lower edges (18*a*) of the two doors (18) provided in the piece of furniture shown in such a figure.

Figure 9A:
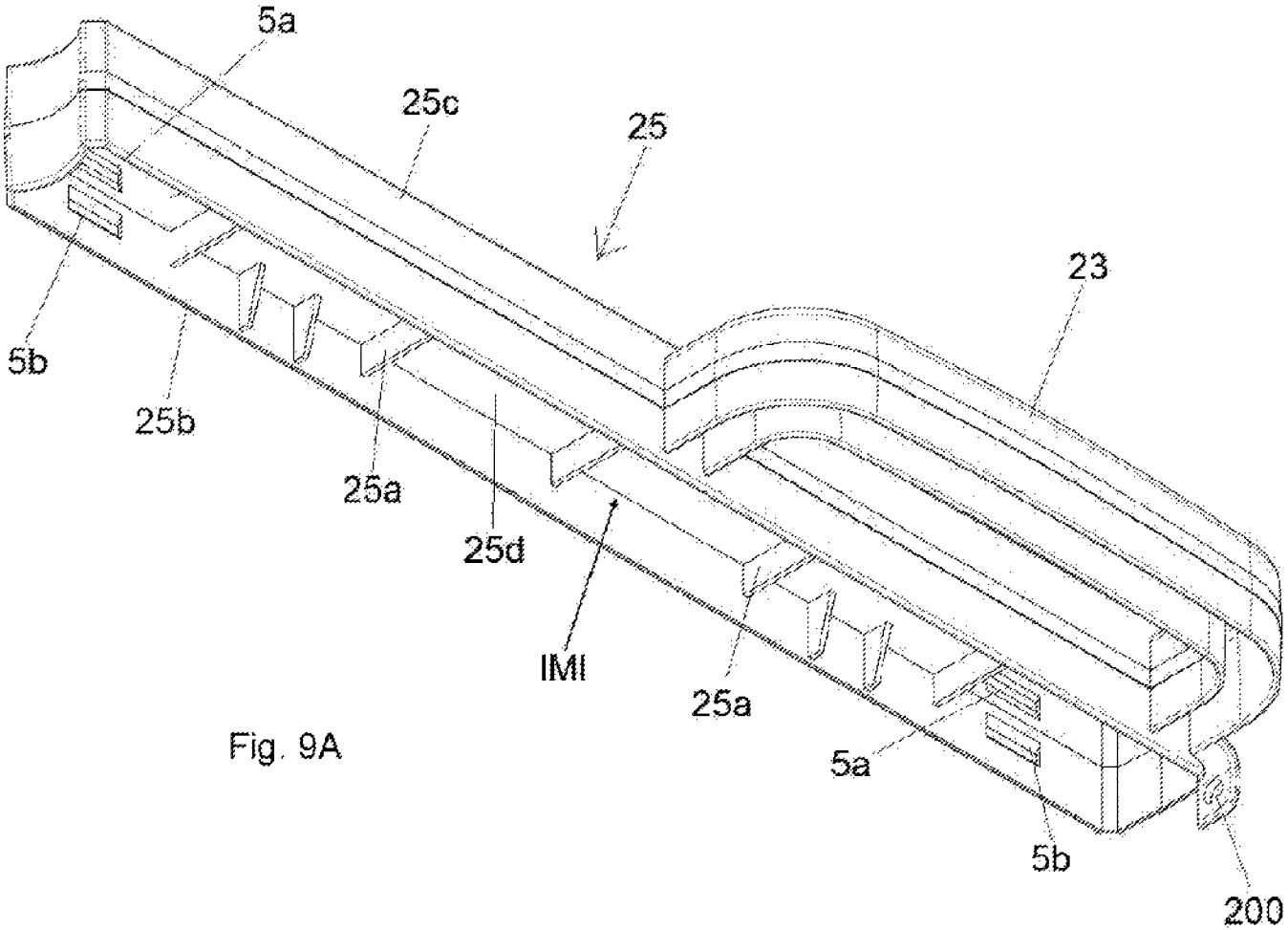
FIG. 9A is an axonometric bottom view of a second strip with handle of the apparatus of the invention.
Figure 9B:
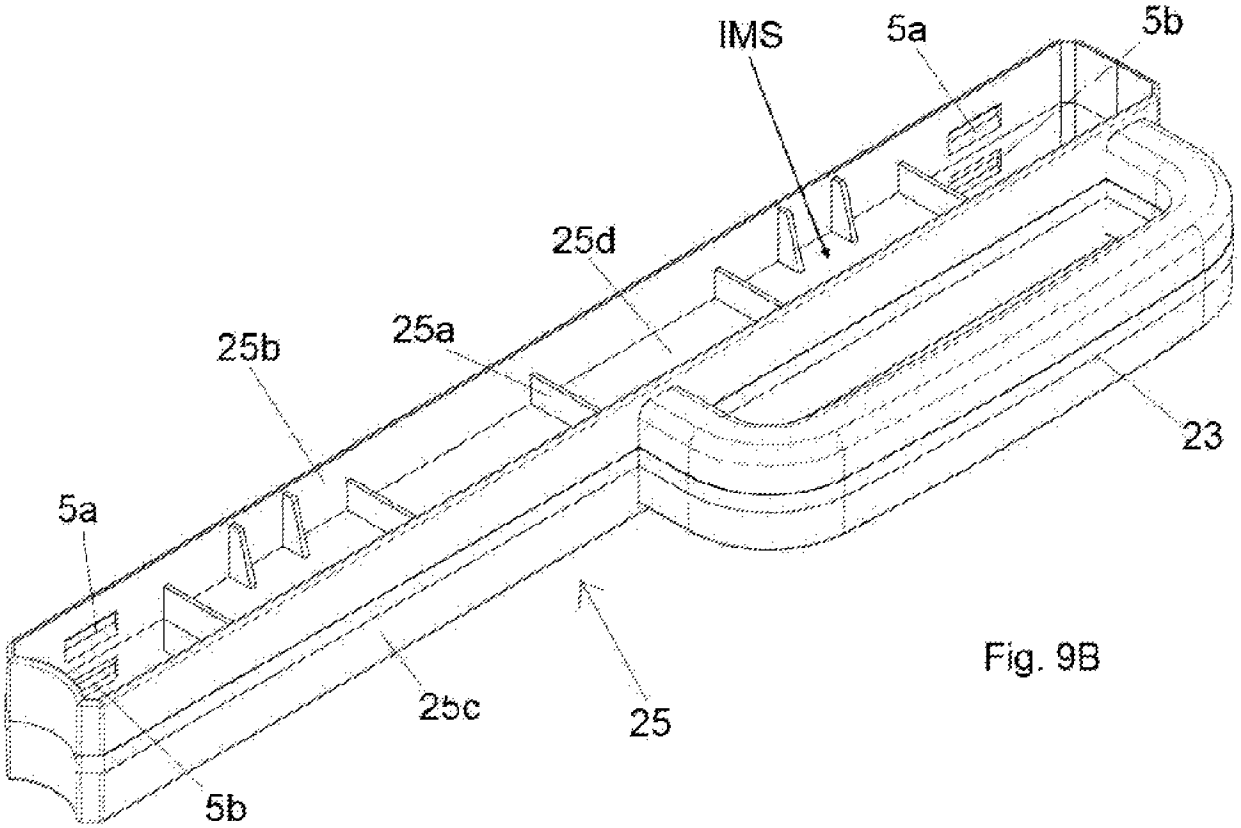
FIG. 9B is an axonometric top view of the strip of FIG. 9A.

FIGS. 9A and 9B refer to an additional component adapted to cooperate with said door (18); it is a first connection strip (25) provided with lateral handle (23).

Said strip (25) is not adapted to finish the upper and lower edges of a door (18), but acts as connection between two doors, connecting the upper edge (18*b*) of the underneath door and the lower edge (18*a*) of the above door.

The functional destination of said first connection strip (25) is shown in FIG. 19A and in the exploded drawing of FIG. 19B, which also shows a second connection strip (25') identical to the first strip (25) but not provided with lateral handle.

First of all, it must be noted that, being adapted to connect two doors (18), the first connection strip (25) has height double than the first finishing strip (22) and is provided with two opposite mouths, the first one (IMI) facing downwards, and the second one (IMS) facing upwards.

As shown in FIGS. 9A and 9B, exactly at half of its thickness, said first connection strip (25) is internally provided with a horizontal wall (25*d*) connected on both sides with a series of vertical transversal partitions (25*a*).

Said horizontal wall (25*c*) does not extend until the ends of the strip (25), where said first lateral edge (25*b*), opposite to the edge (25*c*) that supports the handle (23), is provided with two pairs of horizontal slots (5*a*, 5*b*), one above the other; it being provided that the first slot (5*a*) of each pair is situated at higher height than the horizontal wall (25*d*) and the second slot (5*b*) is situated at a lower height.

Coupling between said first connection strip (25) and the two doors (18) mounted above and under the strip (25) is obtained according to the same modes illustrated above with reference to said first finishing strip (22).

When the horizontal edges (18*a*, 18*b*) of the doors (18) are engaged on opposite sides into said first connection strip (25), the pairs of V-shaped notches (12) provided on said edges (18*a*, 18*b*) conjugate with said transversal partitions (25*a*) provided inside said strip (25).

At the same time, the two wedge profiles (19*a*) of the door (18) are fitted into the first slots (5*a*) of the first connection strip (25) and the two wedge profiles (19*b*) of the underneath door (18) are fitted in the second slots (5*b*) of the strip (25).

Figure 10:
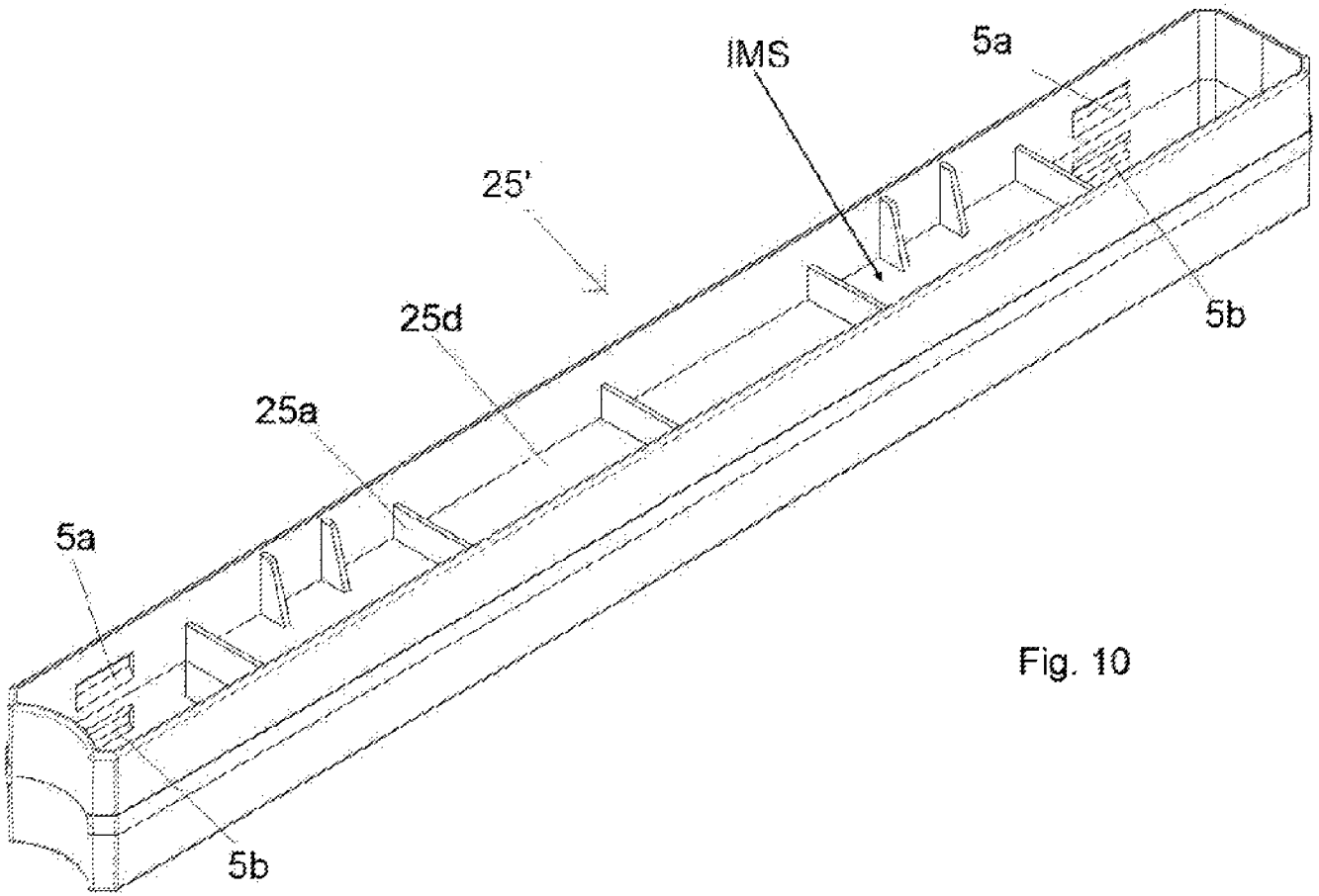
FIG. 10 is an axonometric bottom view of a second strip without handle of the apparatus of the invention.

FIG. 10 shows said second connection strip (25'), which basically has the same configuration as the first connection strip (25), with the only difference that it is not provided with lateral handle.

Said second connection strip (25') is internally provided with a series of vertical transversal partitions (25*a*), a horizontal partition (25*d*) and two pairs of horizontal slots (5*a*, 5*b*) situated towards the ends.

FIG. 19C, which shows the same piece of furniture as FIG. 19A with closed doors, is an additional representation of the cooperation modes between the doors (18) and said finishing and connection strips.

Specifically referring to FIGS. 7A and 9A, it must be noted that the first finishing strip (22) and the first connection strip (25) are provided, in the front with an eye (200) under the handle (23).

When the doors (18) of a piece of furniture are closed—as shown in said FIG. 19C—the eyes (200) of the two adjacent handles (23) are disposed side-to-side and can be used to insert the hook of a lock, the ends of a chain or any other means used to obtain the safe locking of the piece of furniture.

Figure 11A:
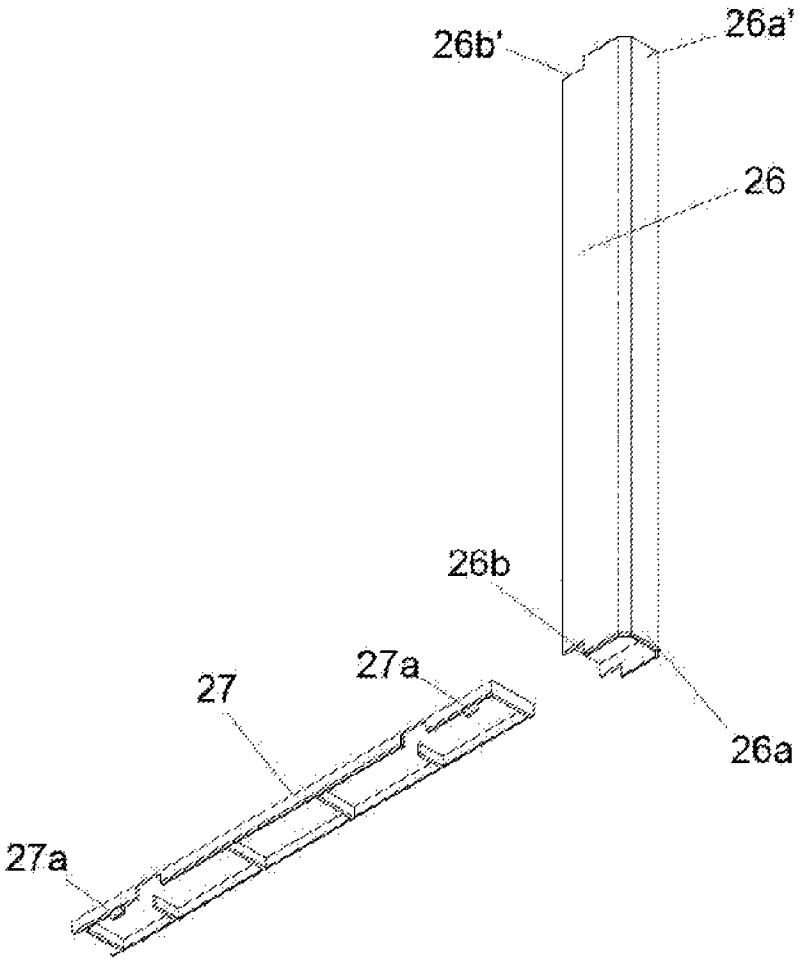
FIG. 11A is an axonometric view of a plate and a column of the apparatus of the invention.

FIG. 11 A refers to two additional components of the apparatus of the invention, which have been devised to provide additional alternative solutions to those who want to use the apparatus of the invention to realize furniture according to their specific requirements.

The first of the components shown in FIG. 11 A is a boxed column (26) with same height as the wall (14), whereas the second component is a rectangular, elongated narrow plate (27).

Figure 11B:
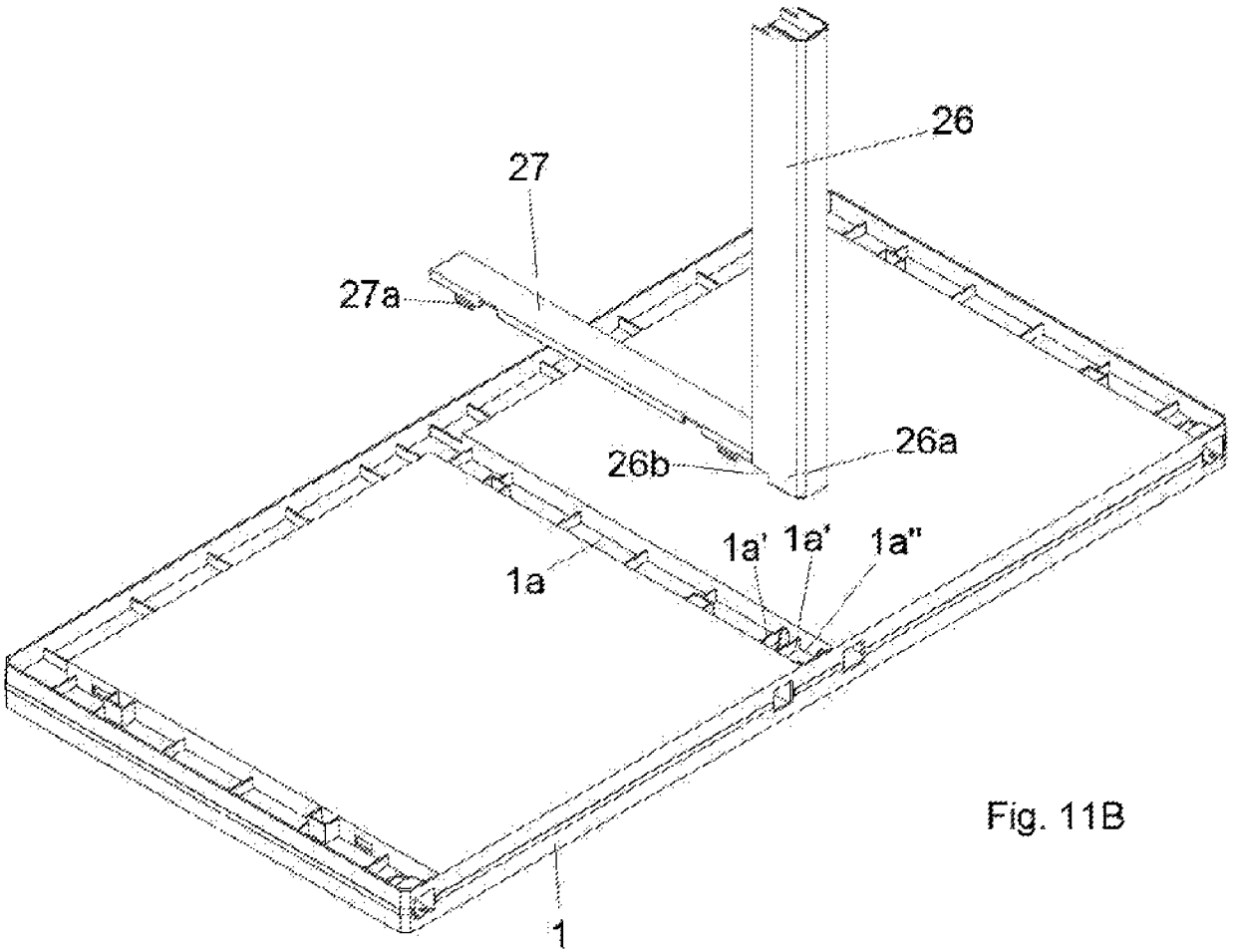
FIG. 11B is an axonometric view of the cooperation modes of two components of FIG. 11A with a specimen of the horizontal panel of FIG. 1A.
Figure 11C:
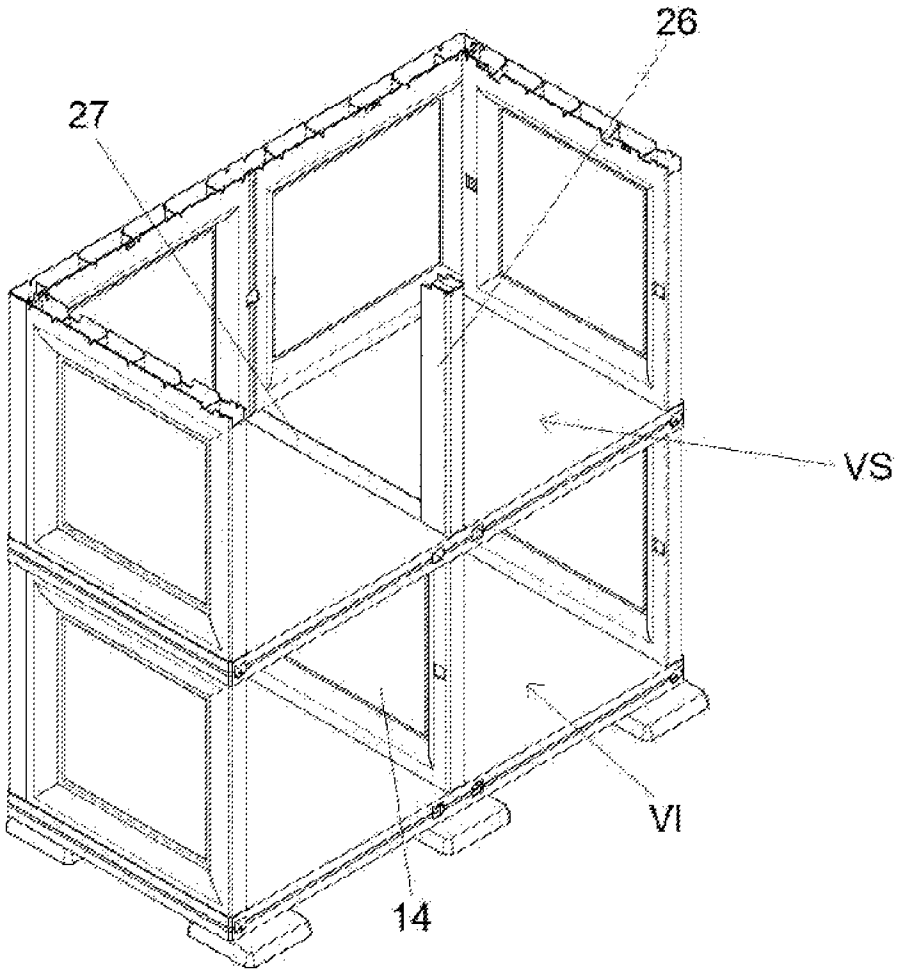
FIG. 11C is an axonometric view of the two components of FIG. 11A installed in a piece of furniture obtained by means of the apparatus of the invention.

Specifically referring to FIGS. 11B and 11C, the column (26) is provided at both ends (26*a*, 26*a*') with a step (26*b*, 26*b*') facing the inward of the piece of furniture.

The lower end (26*a*) of said column (26) is adapted to be exactly engaged into a seat (1*a*") obtained at the front end of the central transversal groove (1*a*) provided on the upper side of said first panel (1); whereas the upper end (26*a*') is adapted to be engaged inside a seat obtained at the front end of the central transversal groove (10*a*) provided on the lower side of said first panel (1) or inside a seat (100*a*") obtained at the front end of the central transversal groove (100*a*) provided on the lower side of said top (16).

The steps (26*b*, 26*b*') provided at the ends (26*a*, 26*a*') of the column (26) allow for avoiding interference of said vertical partitions (1*a*', 10*a*', 100*a*') provided inside said transversal grooves (1*a*, 10*a*, 100*a*).

Instead, the plate (27) is adapted to be forcedly inserted in the remaining pan of the central groove (1*a*) in such manner to create a single uninterrupted surface, in combination with said two continuous portions (2) of the first panel (1).

To that end, the plate (27) is laterally provided with elastically deformable wedge profiles (27*a*) adapted to interfere with the lateral walls of the destination groove (1*a*) and realize a more stable coupling between said two components.

A possible practical use of these two components (26, 27) is shown in FIG. 11C, which shows a piece of furniture with a lower compartment (VI) divided into two halves by an intermediate specimen of said wall (14) and an upper compartment (VS) uninterrupted from one side to the other side of the piece of furniture because of the front use of the column (26).

Said figure shows that, in the upper compartment (VS) of the piece of furniture, the column (26) has the same function as the intermediate wall (14) in the lower compartment (VI), acting as support for an additional horizontal panel (1) or directly for the top (16).

Figure 20A:
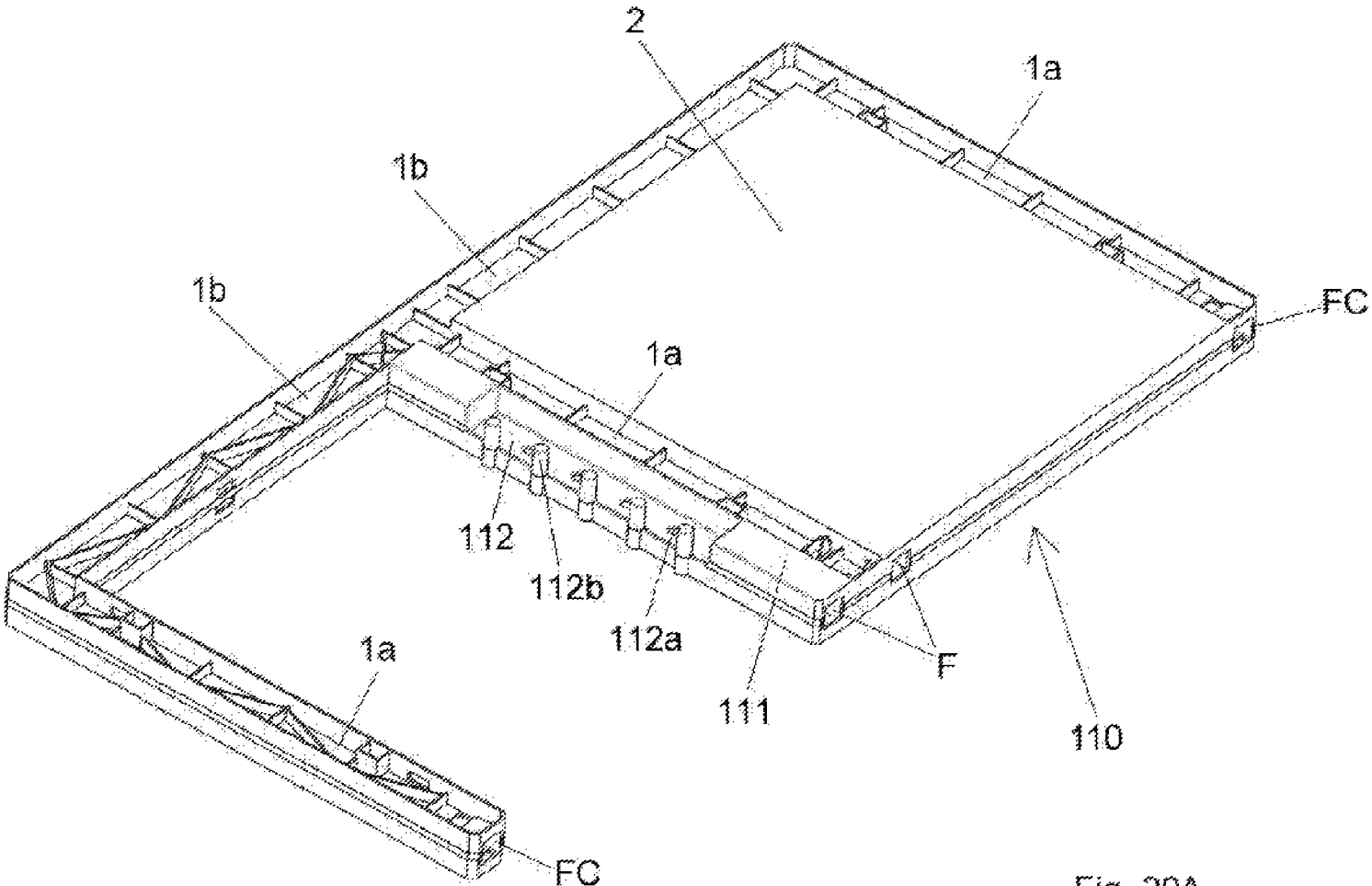
FIG. 20A is an axonometric view of an alternative embodiment of the horizontal panel of FIG. 1A.
Figure 20B:
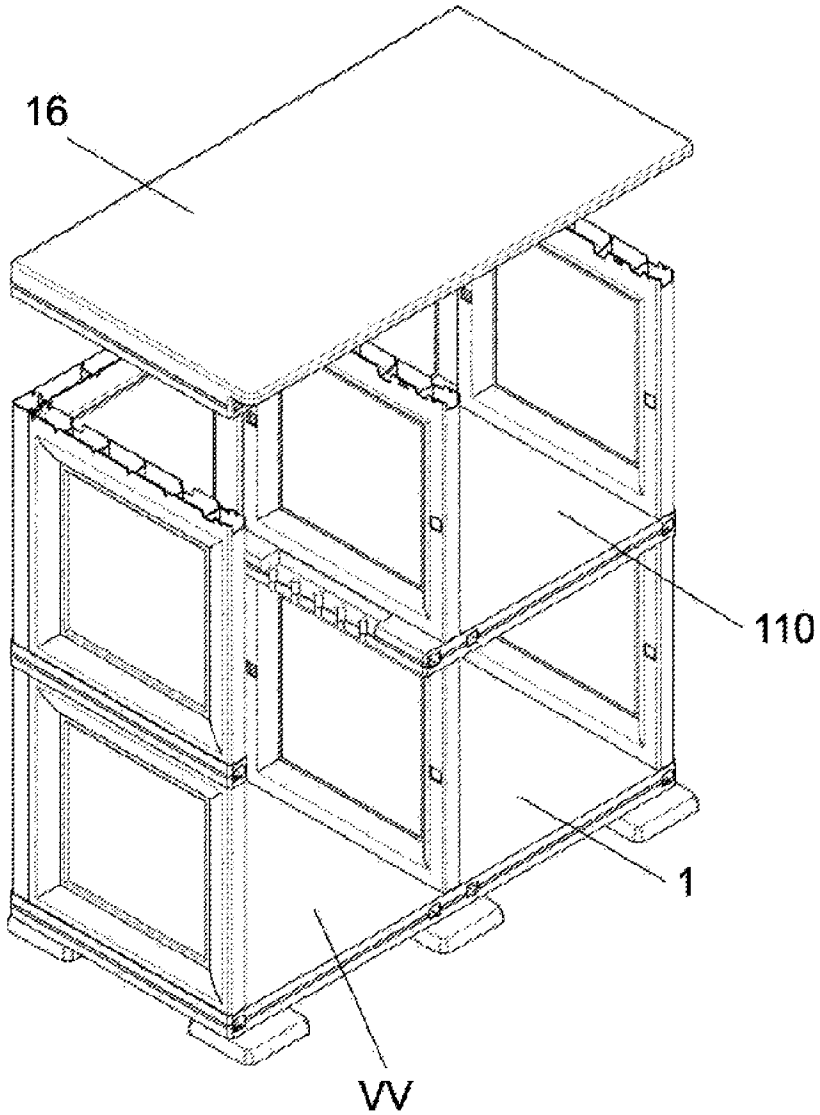
FIG. 20B is an axonometric view of a piece of furniture provided with a specimen of the horizontal panel of FIG. 20A.

Referring to FIGS. 20A and 20B, the apparatus of the invention comprises an additional component adapted to give the user higher discretion during the configuration of the piece of furniture.

FIG. 20B shows a piece of furniture provided on the left-hand side with a compartment (VV) extending in vertical direction, without interruption, from the horizontal bottom panel (1) to the upper top (16), whereas on the right-hand side the corresponding vertical volume is divided into an upper half and a lower half by an intermediate shelf.

The continuous vertical compartment (VV) is obtained by using the component shown in FIG. 20A.

It is a second horizontal panel (110) basically identical, both on the upper and lower side, to said first horizontal panel (1) adapted to act both as bottom and shelf for the piece of furniture.

The peculiarity of the second embodiment (110) of the horizontal panel, which can be defined as "asymmetrical", consists in the fact that it is provided with only one continuous portion (2) on one side of the central transversal groove (1*a*).

On the other side of the central transversal groove (1*a*) only an L-shaped support structure is provided, being composed of half of the rear longitudinal groove (1*b*), at the end of which a corresponding transversal groove (1*a*) is normally connected.

In cooperation with said L-shaped structure, said central transversal groove (1*a*) defines a free space (SL) accessible from the front of the second panel (110).

As shown in FIG. 20A, on the side of said central transversal groove (1*a*), towards said free space (SL), a boxed strip (111) is provided, with upper surface at the same height as the upper surface of said continuous portion (2) provided on the opposite side of the central groove (1*a*).

Said boxed strip (111) is centrally provided with a lowered longitudinal area (112), on the bottom of which regularly spaced holes (112*a*) are obtained, whereas, on the external edge of the same, vertical pegs (112*b*) are obtained in staggered position relative to said boles (112*a*).

When the a symmetrical panel (110) is mounted inside a wardrobe, the holes (112*a*) and pegs (112*b*) can be advantageously used to hook or hang objects or tools of different type.

Unlike the corresponding symmetrical embodiment shown in FIGS. 1A and 1B, such a horizontal asymmetrical panel (110) is adapted to be used only as shelf and not as bottom for the piece of furniture.

Figure 21B:
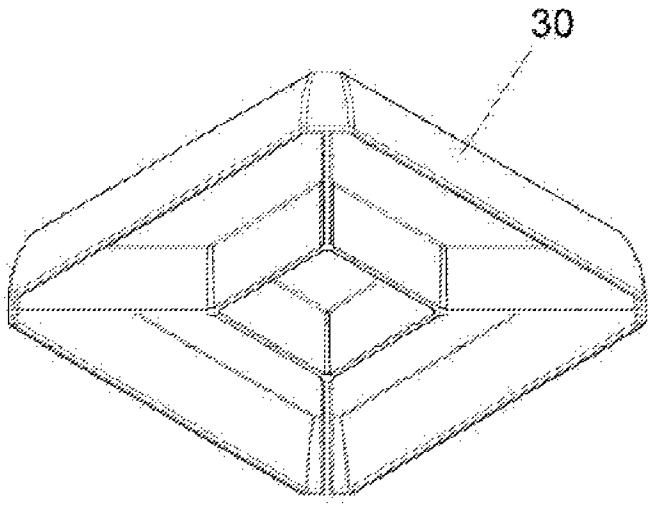
FIGS. 21A and 21B are two axonometric views, a top view and a bottom view, respectively, of the foot of the apparatus of the invention.
Figure 21A:
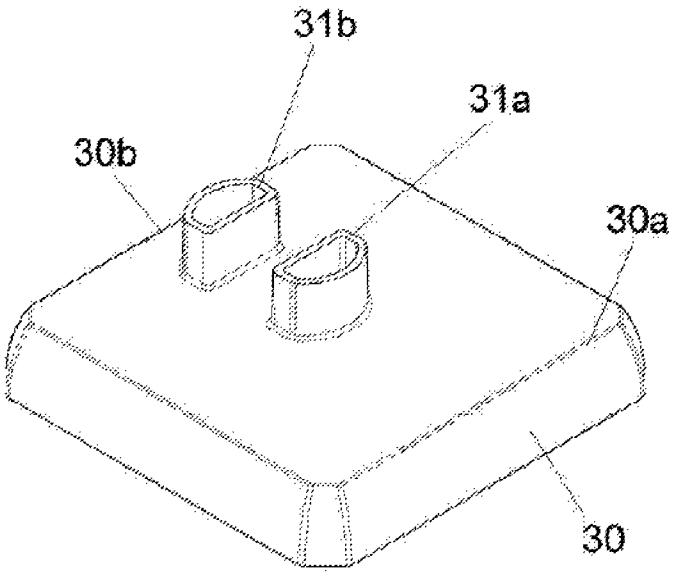

Finally, FIGS. 21A and 21B show the foot (30) adapted to be mounted under said panel (1) when the latter is used as bottom of the piece of furniture.

In particular, said foot (30) has a boxed structure with basically truncated-pyramidal shape with square base and is provided, on the upper planar surface, with a symmetrically opposite pair of vertical plugs (31*a*, 31*b*) with basically semi-elliptical profile.

The function of said plugs (31*a*, 31*b*) is to be engaged into corresponding tubular seats (32) provided on the lower side of the panel (1) and illustrated in said FIG. 1B, in such manner to create a prismatic anti-rotation coupling.

The peculiarity of the pair of plugs (31*a*, 31*b*) provided on each foot (30) consists in the fact that they occupy a off-centered position relative to said upper planar side of the latter.

The first (31*a*) of these plugs is basically situated in the center of the foot (30), whereas the second (31*b*) is basically situated at half of the distance between said first plug (31*a*) and the rear edge (30*b*) of the foot (30).

The above has been devised in order to couple the foot (30) to the panel (1) according to two different modes.

In particular, this alternative mounting solution of the feet (30) is used with reference to the three specimens that must be mounted in correspondence of the front longitudinal edge of the panel (1).

Figure 22A:
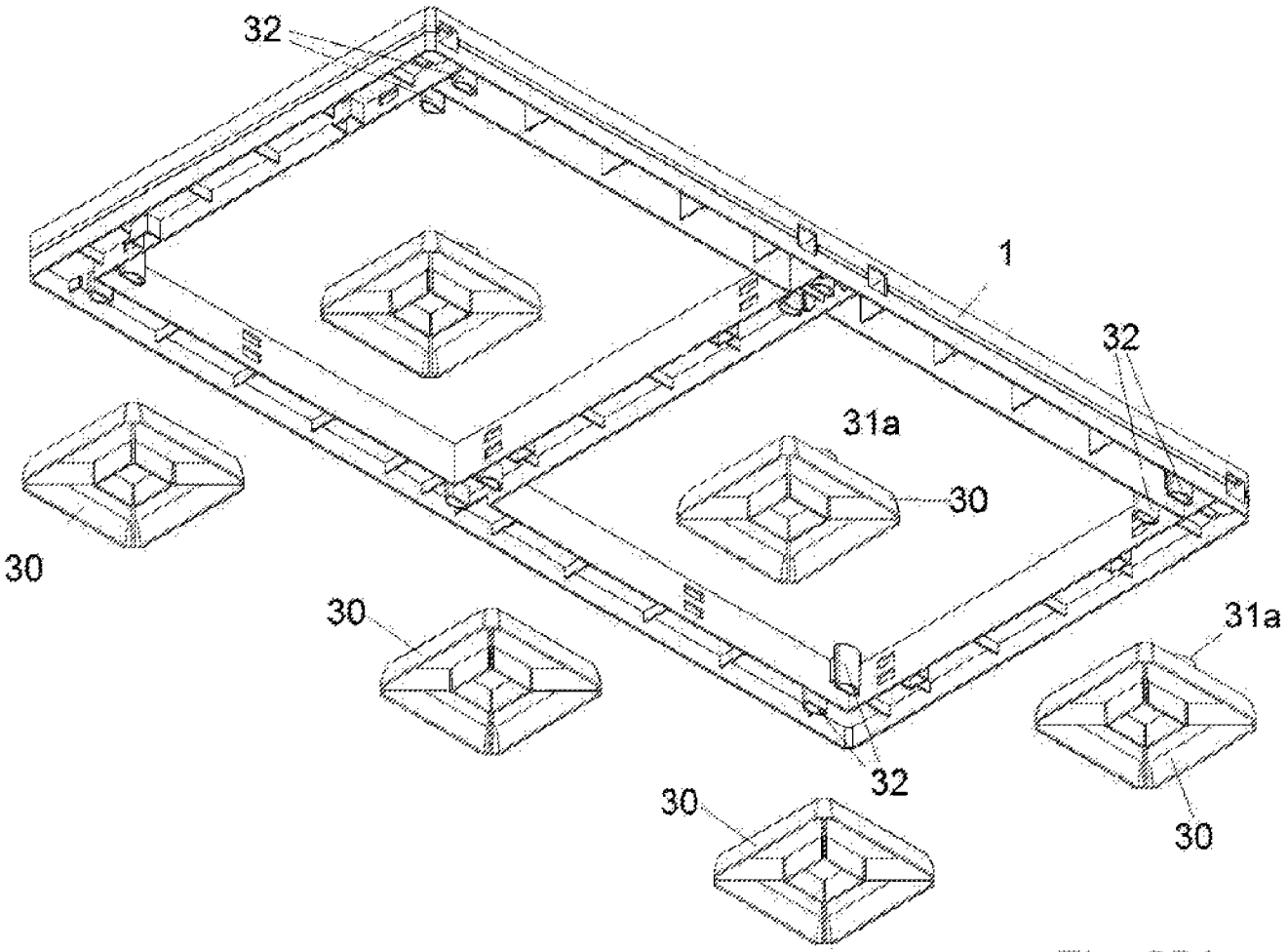
FIGS. 22A, 22B and 22C are three axonometric views showing in sequence a first assembly mode of the foot of FIGS. 21A and 21B.
Figure 22B:
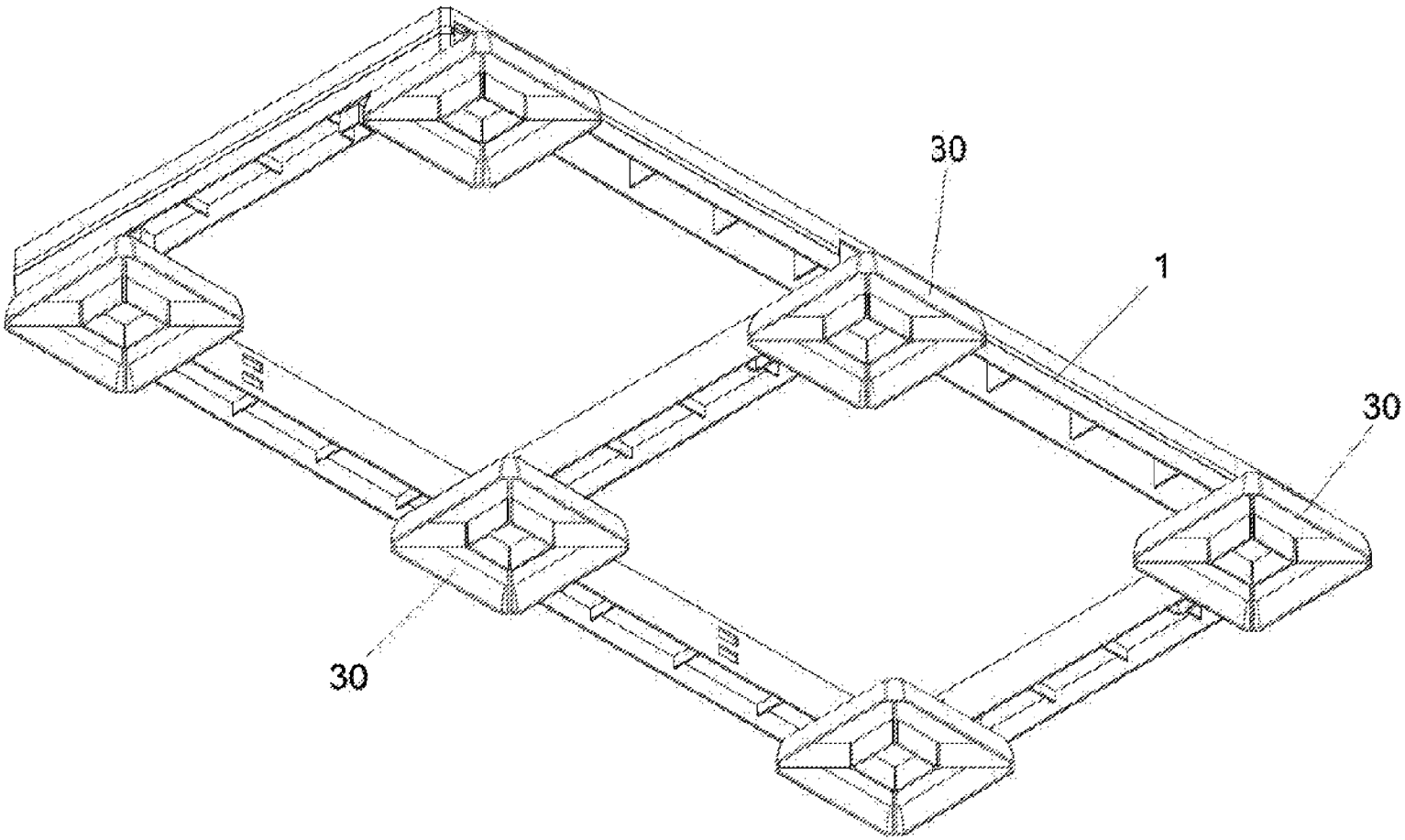
Figure 22C:
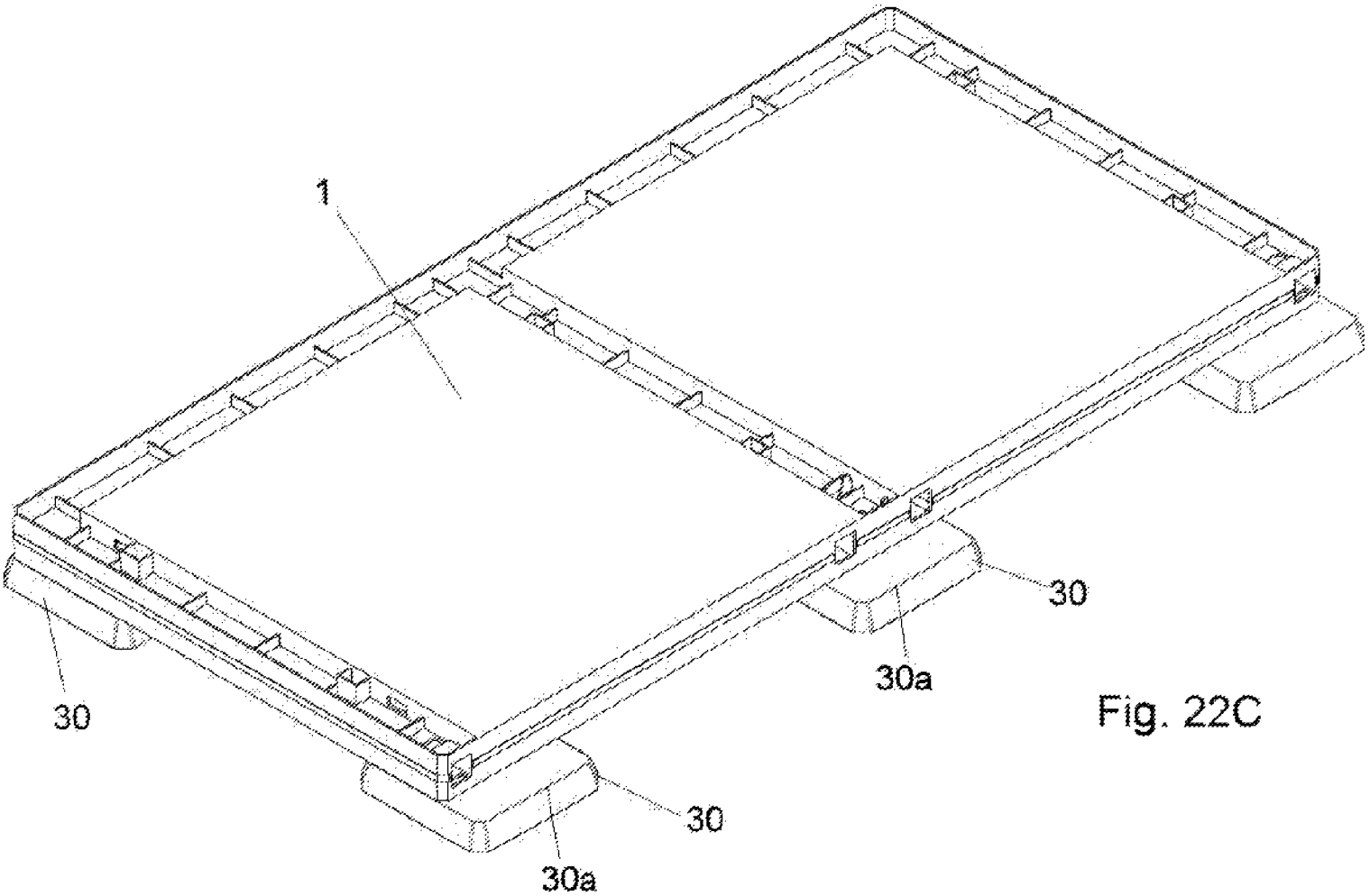

The first of these mounting solutions is shown in sequence in FIGS. 22A, 22B and 22C.

As shown in the aforesaid drawings, the six feet (30) provided on the panel (1) must be engaged against the lower side of the same, in order to realize male-female coupling between the vertical plugs (31) of the first ones and the corresponding tubular seats (32) of the second one.

In particular, FIG. 22C shows that, in such an occasion, the front edge (30*a*) of the three feet (30) applied on the front of the panel (1) is disposed in significantly protruding position relative to the front longitudinal edge of the panel (1).

Figure 23A:
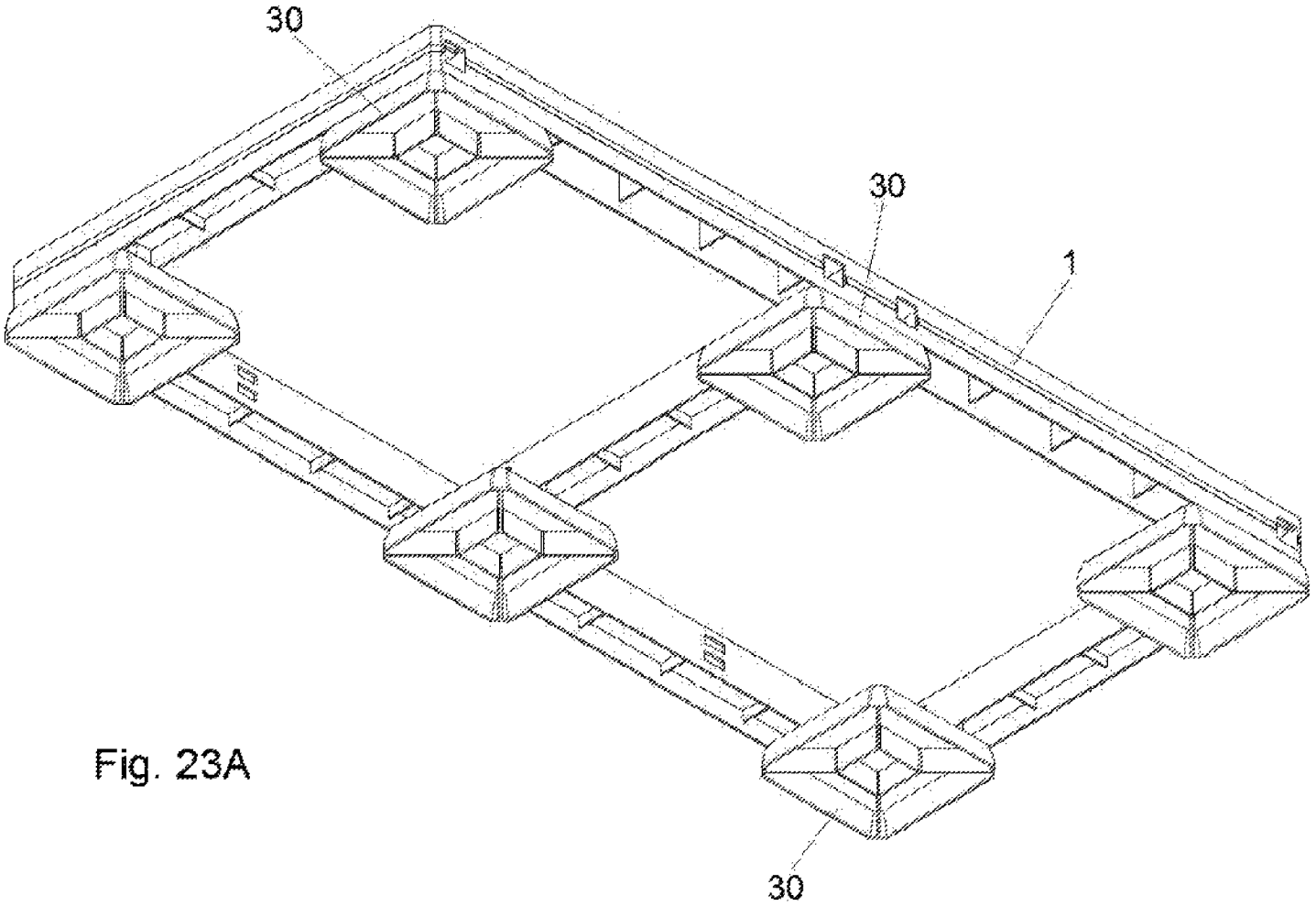
FIGS. 23A and 23B are two axonometric views showing in sequence a second assembly mode of the foot of FIGS. 21A and 21B.
Figure 23B:
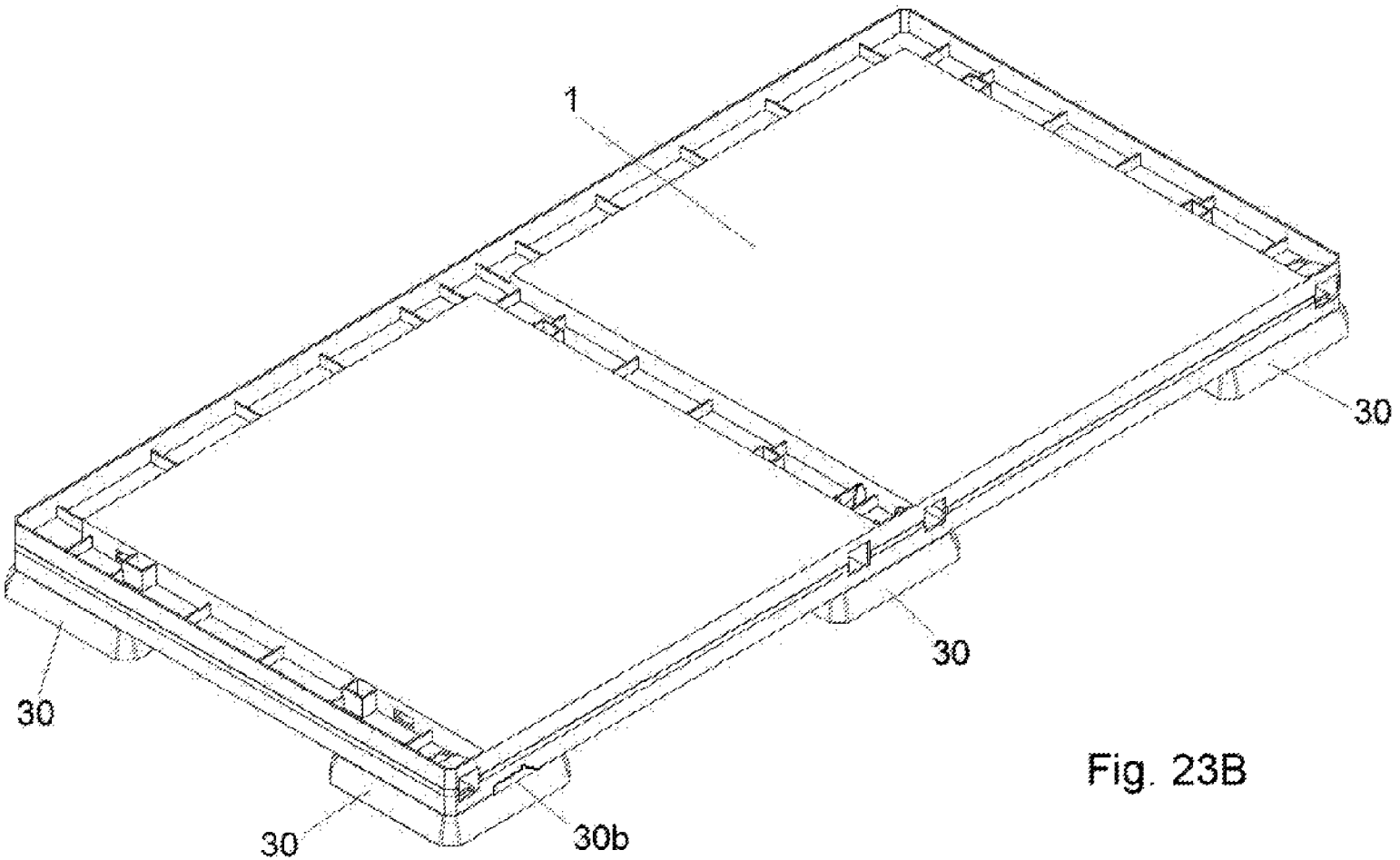

Instead, FIGS. 23A and 23B show that the three feet (30) are mounted in such manner that the rear edge (30*b*) is perfectly flush with the longitudinal edge of the panel (1).

It is worthless saying that the two alternative mounting solutions of said feet (10) can be implemented on condition that, before insertion on the lower side of the panel (1), said feet (30) are given 180 alternative rotation, thus taking advantage of said off-centering provided for the pairs of vertical plugs (31*a*, 31*b*).

Finally, it must be noted that the "protruding" position of the feet (30) of FIG. 22C is preferred when the wardrobe is provided with doors; so, the front edge (30*a*) of each foot (30) is basically flush with the front side of the doors, as shown in FIGS. 19A and 19C.

Instead, the "non-protruding" position of the feet (30) in FIG. 23B is preferred when the wardrobe is not provided with doors, since the front projection of the feet (30) would be anti-aesthetic, useless and cumbersome; reference is made to FIG. 17.

The invention claimed is:

1. A modular apparatus for realization of wardrobes and the like, comprising the following modules obtained from molding plastic materials:

a first boxed quadrangular panel adapted to act as bottom or shelf for a piece of furniture and the first panel comprising:

an upper side having longitudinal coupling means and transversal coupling means provided with stopping means, and a lower side having longitudinal and transversal coupling means provided with stopping means; said longitudinal coupling means being situated at least in correspondence of a rear longitudinal edge of the first panel and said transversal coupling means being situated in correspondence of a transversal edges and a central area of the first panel;

a boxed quadrangular back for the piece of furniture, provided with a lower longitudinal edge and an upper longitudinal edge adapted to cooperate with said longitudinal coupling means of said first panel and said lower and upper longitudinal edge of the back being provided with stopping means adapted to cooperate with said stopping means provided on said longitudinal coupling means of the first panel;

a boxed quadrangular wall adapted to act as side or internal partition of the piece of furniture, said wall provided with a lower longitudinal edge and an upper longitudinal edge adapted to cooperate with said longitudinal coupling means of said first panel and said wall provided with stopping means adapted to cooperate with said stopping means provided on said transversal coupling means of the panel;

a boxed quadrangular top for the piece of furniture, said top comprising a lower side provided with longitudinal coupling means and transversal coupling means provided with stopping means and disposed in specular position to the longitudinal and transversal coupling means of said first panel; said longitudinal coupling means of the top being adapted to cooperate with the upper longitudinal edge of the back and the stopping means of the top being adapted to cooperate with the stopping means provided on the upper longitudinal edge of the back; said transversal coupling means of the top being adapted to cooperate with the upper longitudinal edge of the wall and the stopping means of the top are adapted to cooperate with the stopping means provided on the upper longitudinal edge of the wall.

2. The apparatus of claim 1, wherein said longitudinal and transversal coupling means provided on said first panel comprise respectively in rectilinear longitudinal grooves and transversal grooves; the longitudinal and transversal grooves obtained on the upper side of the first panel being separated from the longitudinal and transversal grooves obtained on the lower side of the first panel by means of a horizontal partition; said longitudinal grooves are adapted to exactly house, respectively, said lower and upper longitudinal edge of the back until the longitudinal grooves are stopped against the horizontal partition and said transversal grooves are adapted to respectively house said lower and upper longitudinal edge of the wall, until the transversal grooves are stopped against the horizontal partition.

3. The apparatus of claim 2, wherein each said rectilinear grooves of said first panel is provided with a regularly spaced series of transversal partitions having height lower than depth of the grooves.

4. The apparatus of claim 1, wherein said lower edge and upper edge of the back, as well as said lower edge and upper edge of the wall are provided with regularly spaced opposite pairs of V-shaped notches; wherein each pair of said notches is adapted to be coupled, in "astride" position, with one of said transversal partitions protruding from said grooves, during the insertion of said edges of the back into the longitudinal grooves of the first panel and the insertion of said edges of the wall into the transversal grooves of the first panel.

5. The apparatus, of claim 1, wherein said stopping means provided on said first panel comprise pairs of horizontal slots, one on top of the other, wherein a first slot is obtained on a lateral side of the grooves provided on the upper side of the first panel, whereas a second slot is obtained, with interposition of said horizontal partition, on the lateral edge of the grooves provided on the lower side of the first panel.

6. The apparatus of claim 1, wherein said stopping means provided on the lower and upper longitudinal edge of the back comprise pairs of wedge profiles and said stopping means provided on the lower longitudinal edges of the vertical wall comprise pairs of wedge profiles said wedge profiles respectively provided on the lower longitudinal edge of the back and the lower longitudinal edge of the vertical wall being adapted to be fitted into the first slots (5*a*) respectively provided on the longitudinal groove (1*b*) and the transversal grooves (1*a*) of the upper side of the first panel; said wedge profiles respectively provided on the upper longitudinal edge of the back and the upper lower longitudinal edge of the vertical wall being adapted to be fitted into the second slots respectively provided on the longitudinal groove and the transversal grooves of the lower side of the first panel.

7. The apparatus of claim 1, wherein said longitudinal and transversal coupling means provided on the top comprise rectilinear grooves respectively adapted to house the upper longitudinal edge of the back and the upper longitudinal edge of the wall.

8. The apparatus of claim 7, wherein each rectilinear grooves of the top is provided with a series of transversal partitions with height lower than the depth of the corresponding groove; being adapted to be coupled with one of said opposite pairs of V-shaped notches provided on the upper longitudinal edges of back and wall, during the insertion of said upper longitudinal edges of the back and each wall inside the grooves.

9. The apparatus of claim 8, wherein said stopping means provided on the top comprise second slots obtained in one of the side edges of said grooves and said slots being adapted to receive said wedge profiles respectively obtained on the tipper longitudinal edge of the back and on the upper longitudinal edge of the wall.

10. The apparatus of claim 1, wherein said first panel is provided on the upper side with two portions one of said transversal grooves being interposed between said two portions.

11. The apparatus of claim 1, wherein said panel is provided on the lower side with multiple pairs of tubular seats with vertical axis in the proximity of front and back longitudinal edges of the panel.

12. The apparatus of claim 1, wherein said panel is provided with a seat obtained at a front end of the central transversal groove provided on the upper side of the panel and an identical seat at a front end of the transversal groove provided on the lower side of the panel.

13. The apparatus of claim 1, wherein said top is provided with a seat obtained at a front end of the central transversal groove provided on the lower side of the panel.

14. The apparatus of claim 1, wherein said back is provided on the front side with coupling means disposed in alignment with said transversal coupling means provided on said panel and said coupling means being adapted to cooperate with coupling means provided on the back vertical edge of each of said walls.

15. The apparatus of claim 14, wherein each coupling means provided on the back comprise a vertical rectilinear groove and the coupling means provided on each walls comprises a rectilinear rib adapted to be inserted into said groove.

16. The apparatus of claim 1, wherein said back and said wall have the same empty structure internally stiffened by transversal ribbing with vertical direction.

17. The apparatus of claim 1, wherein said panel and said top are provided, with four square holes, wherein two square holes are situated towards the ends of the front edges and two square holes are situated in symmetrical position in the proximity of the central transversal groove.

18. The apparatus of claim 1, wherein the apparatus comprises an additional module comprising a boxed quadrangular door with coupling means disposed on lower edge (18*a*) and upper edge of the door, said door being associated with stopping means said door being provided, with means for application of hinges.

19. The apparatus of claim 18, wherein the apparatus comprises additional modules comprising:

a first and a second boxed finishing strip, provided with one mouth for insertion of said lower and upper edge of the door; said one mouth of the finishing strips is provided, with coupling and stopping means adapted to cooperate with corresponding coupling and stopping means provided on the lower and upper edge of the door; and a first and a second boxed connection strip provided with two opposite mouths for insertion of said lower and upper edge of the door; each month of said connection strips being provided, with coupling and stopping means adapted to cooperate with corresponding coupling and stopping means provided on the lower and upper edge of the door.

20. The apparatus of claim 19, wherein said coupling means provided on the lower and upper longitudinal edges of the door comprise of regularly spaced opposite pairs of V-shaped notches and the coupling means of said boxed finishing strips and connection strips comprise of vertical transversal partitions situated between the opposite longitudinal edges of the finishing and connection strips and the vertical partitions being adapted to be coupled with said V-shaped notches provided on said lower and upper longitudinal edges of the door.

21. The apparatus of claim 19, wherein said stopping means provided on said lower and upper edges of the door comprise of pairs of wedge profiles and the stopping means of said boxed finishing strips and connection strips comprise of first and second horizontal slots obtained on the first longitudinal edge of the finishing and connection strips for fitting of said wedge profiles of the door.

22. The apparatus of claim 19, wherein said connection strips are internally provided, with a longitudinal partition separating said transversal partitions provided in the first mouth of said mouths of the connection strips from the transversal partitions provided in the second mouth of said mouths of the connection strips; each connection strips being provided, with two of said first horizontal slots situated at height higher than said horizontal partition and two second slots situated at height lower than said horizontal partition.

23. The apparatus of claim 19, wherein a first finishing strip is provided with a handle in external position on the second longitudinal edge.

24. The apparatus claim 19, wherein said a first connection strip is provided with a handle in external position on the second longitudinal edge.

25. The apparatus of claim 19, wherein a first finishing strip and said first connection strip are provided in the front with an eye in the proximity of the corresponding handles.

26. The apparatus of claim 19, wherein a first finishing strip and said a first connection strip are provided, with a omega-shaped projection with elastically deformable structure, adapted to be forcedly inserted into a square holes provided towards the center of the front edge of said panel.

27. The apparatus of claim 18, wherein said means for application of hinges comprise of a tubular cylindrical profile having lower and upper ends respectively disposed at the height of said lower and upper longitudinal edges of the door.

28. The apparatus of claim 27, wherein each hinge is formed of:

a cylindrical sleeve adapted to penetrate into one end of the tubular profile; and a radial plug adapted to be forcedly engaged and blocked into one of said square holes of said panel.

29. The apparatus of claim 28, wherein each radial plug is formed of two converging arms connected by means of an elastically compressible V-shaped bridge and said converging arms being provided with a tooth.

30. The apparatus of claim 18, wherein said door is provided with an empty structure internally stiffened by transversal ribbing.

31. The apparatus of claim 1, wherein the apparatus comprises:

a boxed column having a height identical to the height of wall, the boxed column having a lower end adapted to be inserted into a seat provided at the front end of the transversal groove realized in the center of the upper side of said panel, the boxed column having a upper end adapted to be inserted into a seat provided at the front end of the transversal groove each end of the column being joined with a step; and a rectangular plate adapted to be inserted on the back of said column into said transversal groove provided in the center of the upper side of said first panel, said plate being laterally provided with elastically flexible wedge profiles adapted to be fitted into corresponding first slots provided in vertical edges defining said transversal groove.

32. The apparatus of claim 1, wherein the apparatus comprises an additional component comprises of a second boxed quadrangular panel adapted to act only as shelf for the piece of furniture, said second boxed quadrangular panel having the same shape and dimensions as said first panel and also provided with a rear longitudinal groove connected with three transversal grooves and with a longitudinal groove and three transversal grooves; said second panel is provided with a continuous portion and a boxed strip, said second panel being provided with two square holes.

33. The apparatus of claim 32, wherein said strip of the second panel is centrally provided with a lowered longitudinal area having spaced holes, and vertical pegs obtained in staggered position relative to said holes.

34. The apparatus of claim 1, wherein the apparatus comprises an additional component comprises of a foot for the piece of furniture; said foot having a boxed structure with upper planar side, and two symmetrically opposite plugs (31*a*, 31*b*) protruding from said planar side, said opposite plugs being adapted to be inserted into one of said pairs of tubular seats with vertical axis provided under said first panel.

35. The apparatus of claim 34, wherein said foot has a truncated-pyramidal shape and the two plugs have a semi-elliptical profile; the first of said plugs being situated in the center of the foot, and a second plug is situated at half of the distance between said first plug and the rear edge of the foot.

36. The apparatus of claim 1, wherein said apparatus comprises an additional component comprising of a cap adapted to be forcedly inserted and fitted into said square holes provided on said first panel, second panel and top.

37. The apparatus of claim 36, wherein said cap is provided with an empty pyramidal head with square base, having:

a rear opening defined by a square edge, two opposite pairs of hook-shaped teeth externally protruding from the square edge and having a tilted profile converging towards the center of the cap.

* * * * *